US008337437B2

(12) United States Patent
Hitzmann

(10) Patent No.: US 8,337,437 B2
(45) Date of Patent: Dec. 25, 2012

(54) SYSTEM AND METHODS FOR PROMOTING HEALTH

(76) Inventor: Sue Hitzmann, New York, NY (US)

( * ) Notice: Subject to any disclaimer, the term of this patent is extended or adjusted under 35 U.S.C. 154(b) by 230 days.

(21) Appl. No.: 12/636,543

(22) Filed: Dec. 11, 2009

(65) Prior Publication Data

US 2010/0087761 A1 Apr. 8, 2010

Related U.S. Application Data

(63) Continuation of application No. 11/729,083, filed on Mar. 26, 2007, now abandoned.

(60) Provisional application No. 60/785,746, filed on Mar. 24, 2006, provisional application No. 60/838,755, filed on Aug. 17, 2006.

(51) Int. Cl.
*A61H 1/00* (2006.01)

(52) U.S. Cl. ..... 601/58; 601/46; 601/49

(58) Field of Classification Search ..... 601/23, 601/46, 52, 56–58, 84, 89, 90, 112, 49; 482/10, 482/23, 140, 148
See application file for complete search history.

(56) References Cited

U.S. PATENT DOCUMENTS 1,895,116 A * 1/1933 Wilsey ..... 601/120
2,204,035 A * 6/1940 Decker ..... 601/57
3,981,032 A * 9/1976 Brooks ..... 5/639
4,782,823 A 11/1988 Yamasaki
5,634,887 A 6/1997 Fortier
6,023,801 A * 2/2000 Lamm ..... 5/636
6,064,746 A 5/2000 Nakamura et al.
6,182,313 B1 2/2001 Eschenbach
6,685,729 B2 2/2004 Gonzalez
6,695,796 B1 2/2004 Solmor
6,788,968 B2 9/2004 Pettibon
7,005,811 B2 2/2006 Wakuda et al.
7,131,952 B1 11/2006 Dickholtz et al.
2003/0182358 A1 9/2003 Rowley et al.
2003/0212352 A1 11/2003 Kahn
2004/0071298 A1 4/2004 Geeng
2005/0130812 A1 6/2005 DiOrio et al.
2005/0226449 A1 10/2005 Young
2005/0245372 A1 11/2005 Mylrea et al.

* cited by examiner

*Primary Examiner* — Kristen Matter
(74) *Attorney, Agent, or Firm* — Kenyon & Kenyon LLP

(57) ABSTRACT

A system made up of methods and techniques designed to improve the body's postural alignment, joint range, muscle hydration, bone density, and overall musculoskeletal health. The system combines a series of exercises designed to lengthen and strengthen muscles, fascial and myofascial tissue. The system is used in combination with a vibrating roller device, which can also be used with a head cradle. The application of the vibrational motion to the body in combination with the techniques described herein work to stimulate fascial tissue and confer benefits on the user which will improve the overall quality of life.

10 Claims, 50 Drawing Sheets

(SECTION A-A)

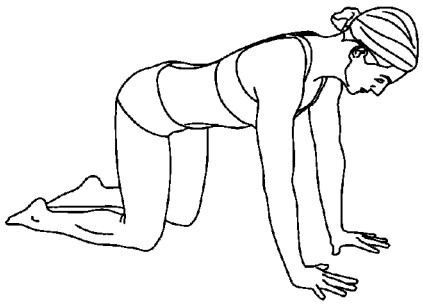
FIG.4-A
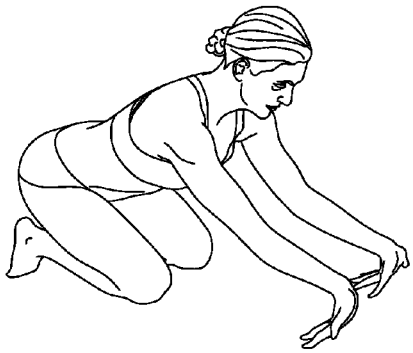
FIG.4-B
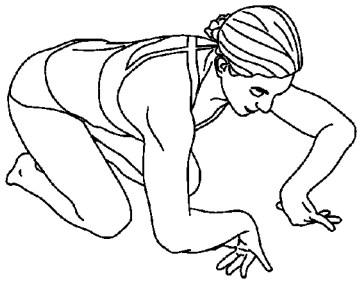
FIG.4-C

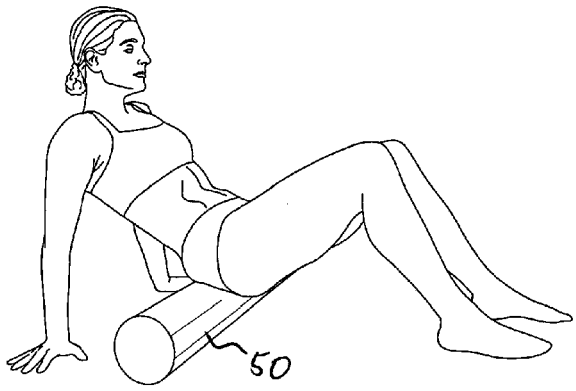
FIG.10-A
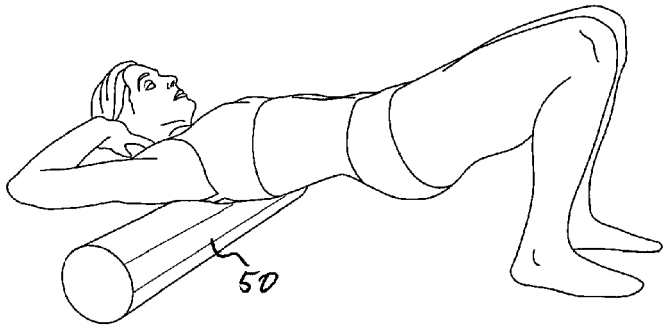
FIG.10-B
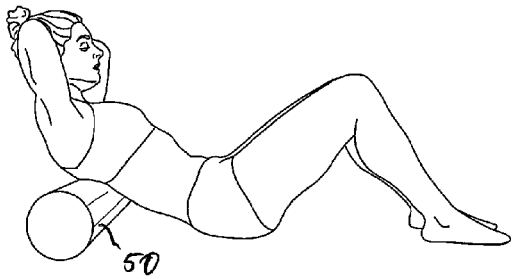
FIG.10-C

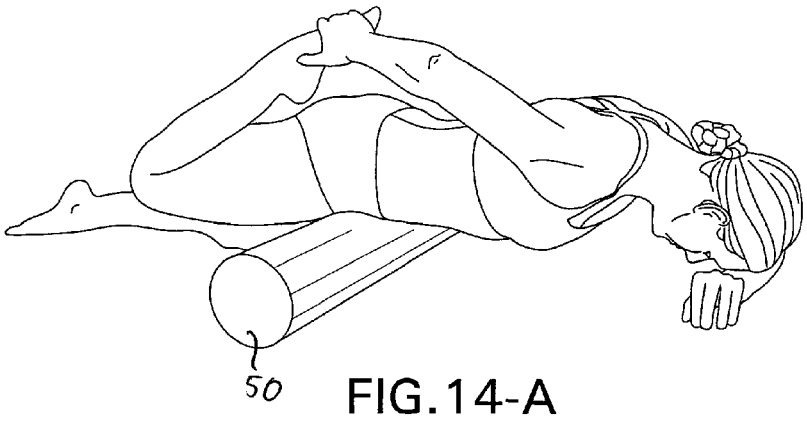
FIG.14-A
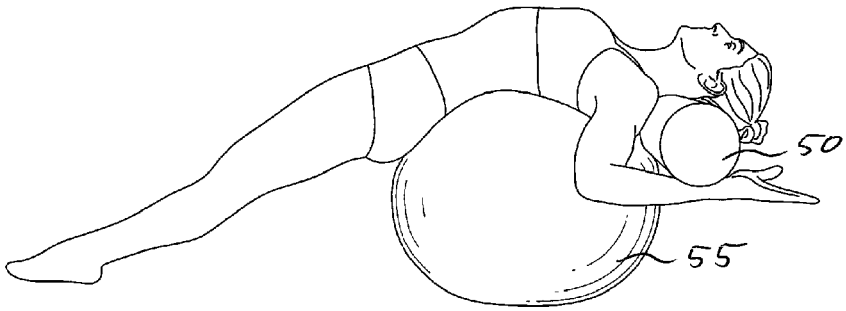
FIG.14-B

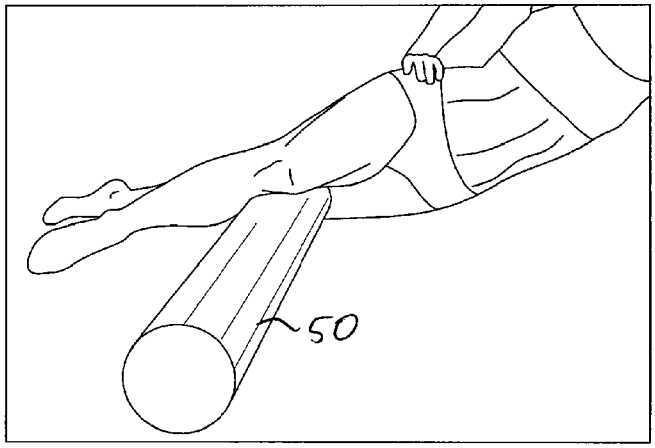
FIG.17-A
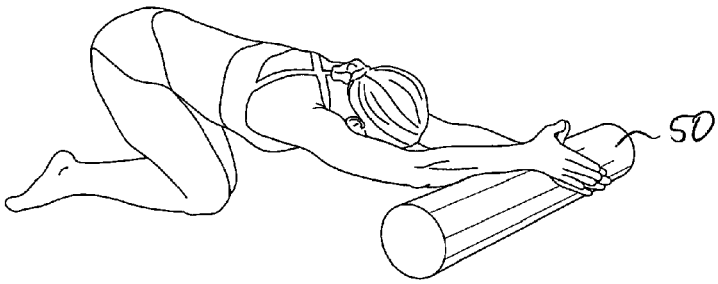
FIG.17-B
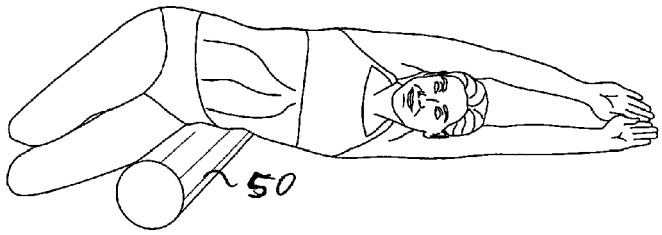
FIG.17-C

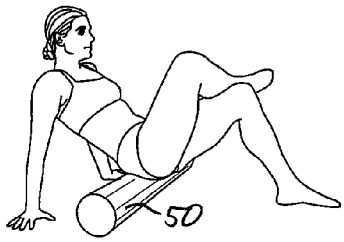
FIG.20-A
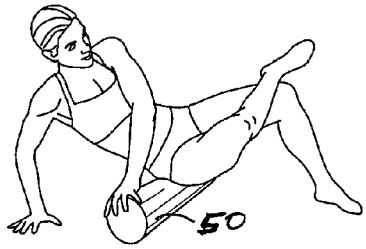
FIG.20-B
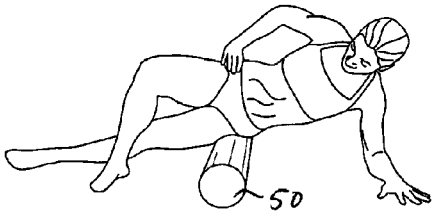
FIG.20-C
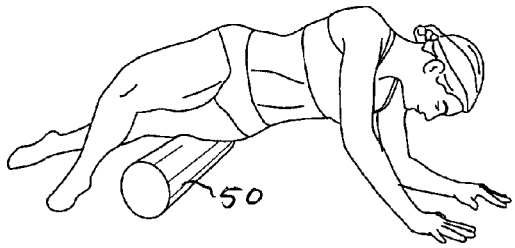
FIG.20-D

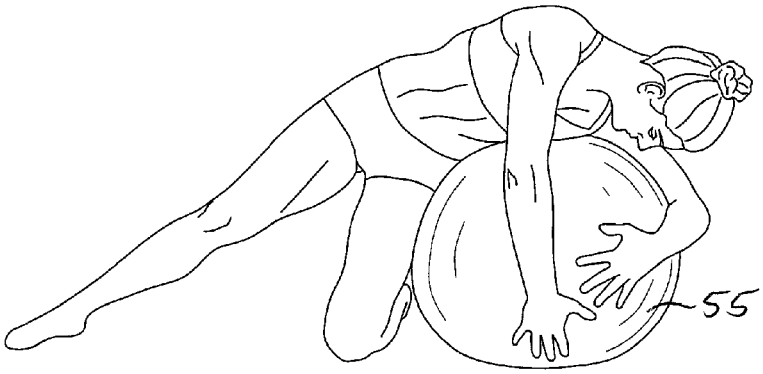
FIG.21-A
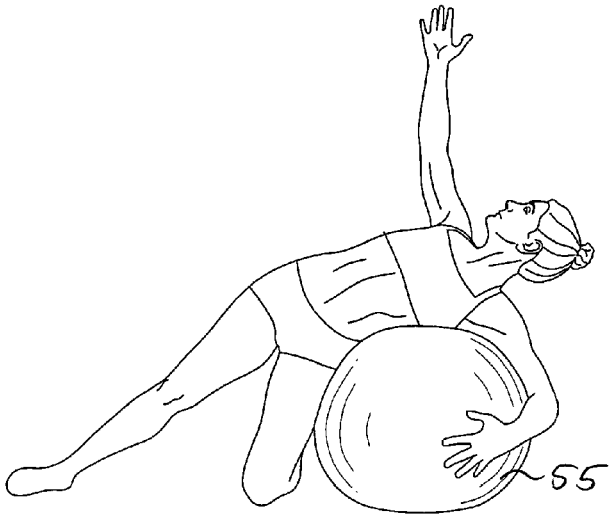
FIG.21-B

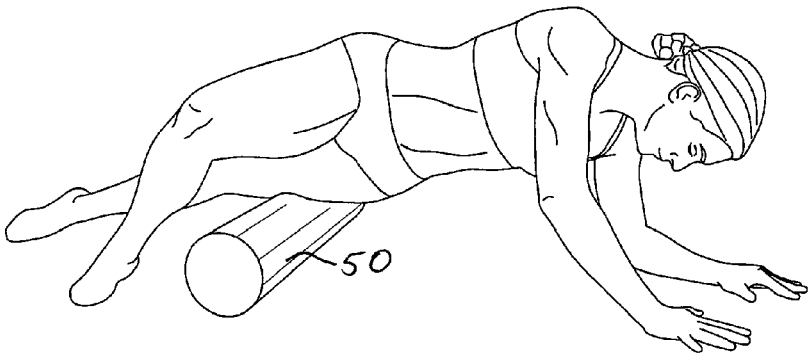
FIG.22-A
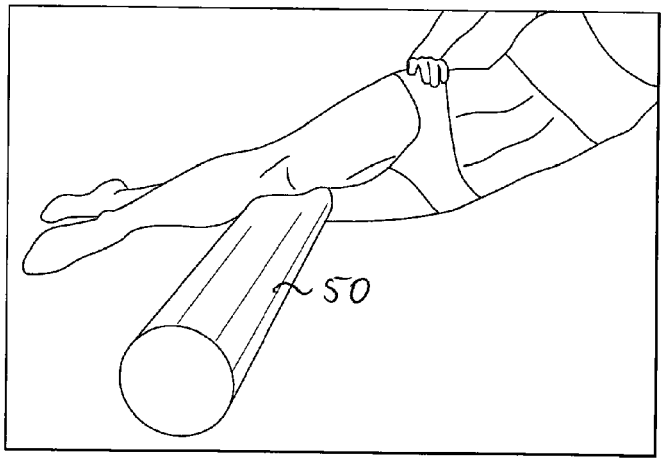
FIG.22-B

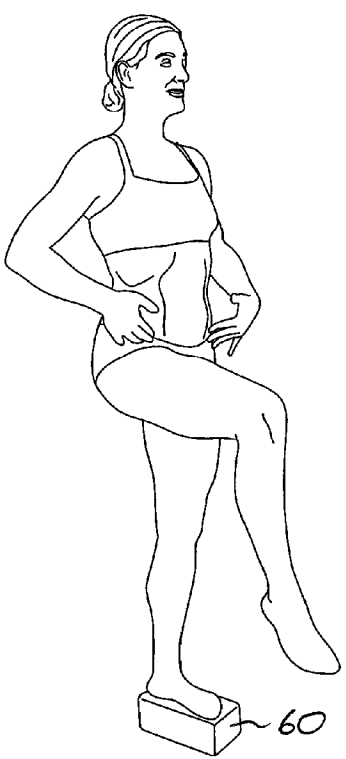
FIG. 24-C
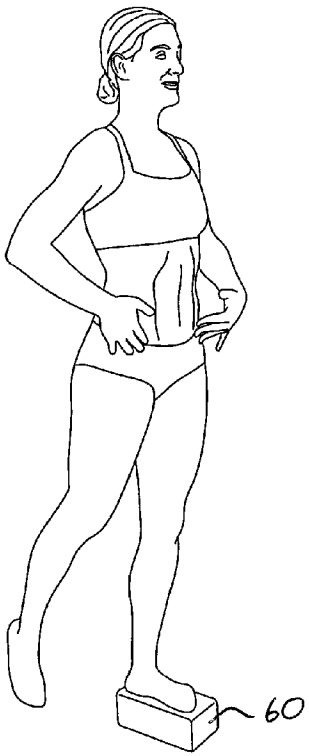
FIG. 24-B
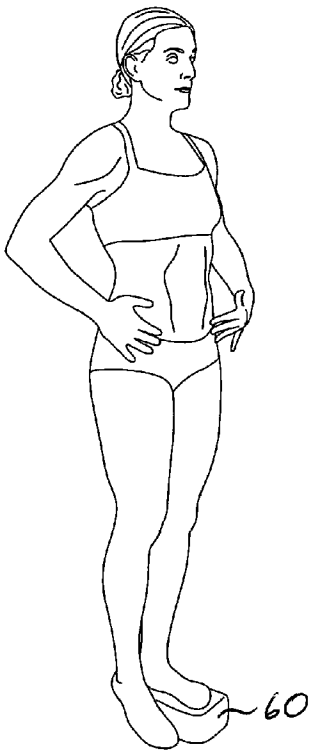
FIG. 24-A

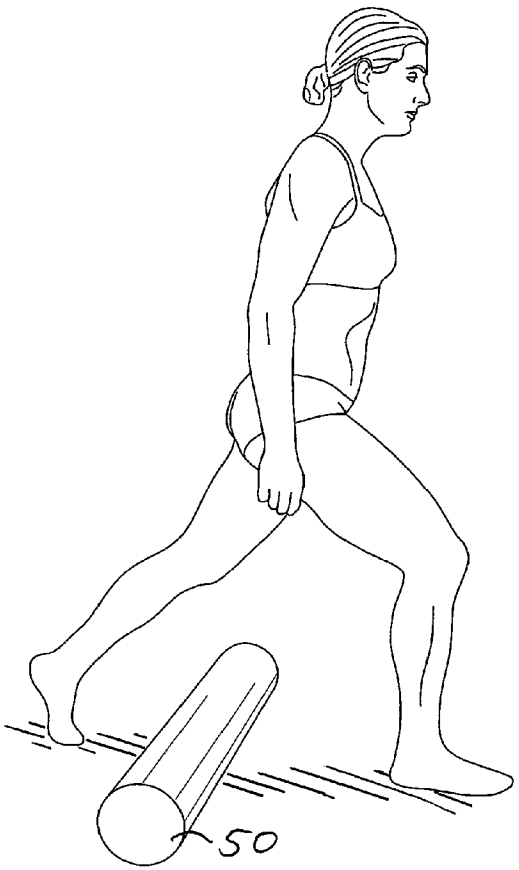
FIG.26-B
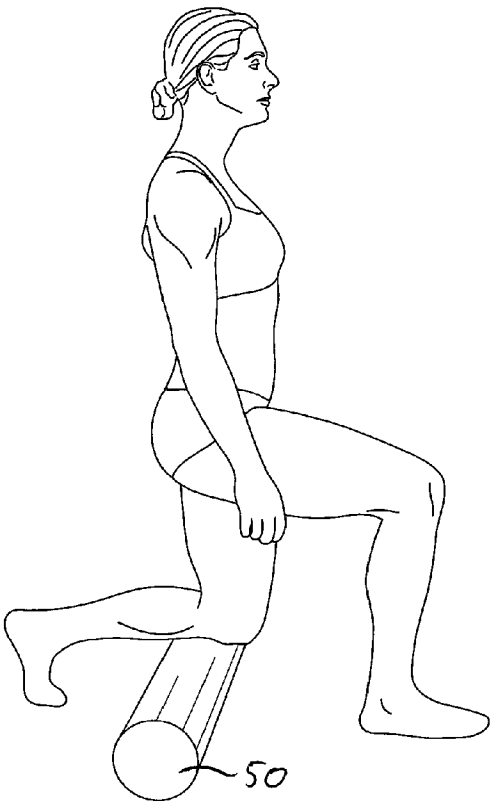
FIG.26-A

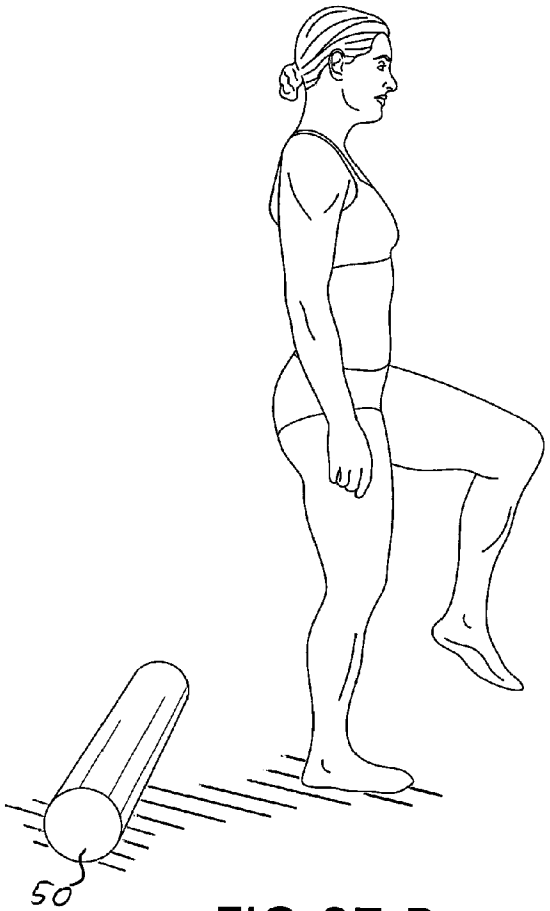
FIG.27-B
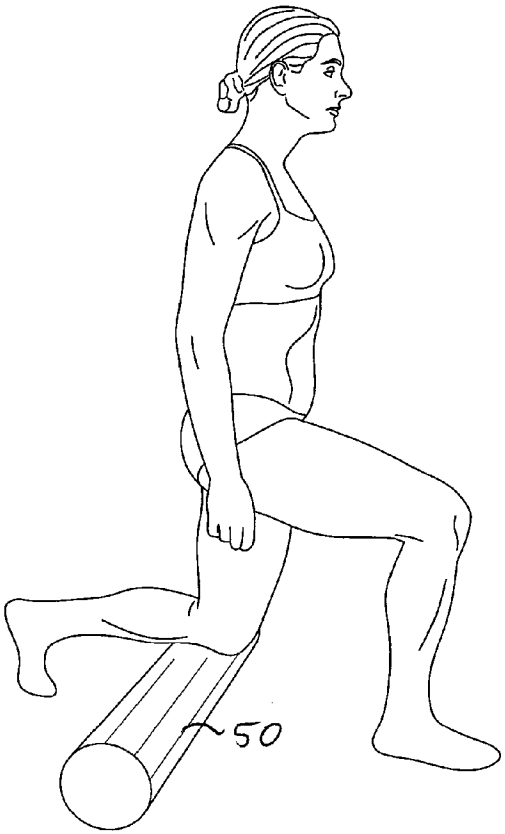
FIG.27-A

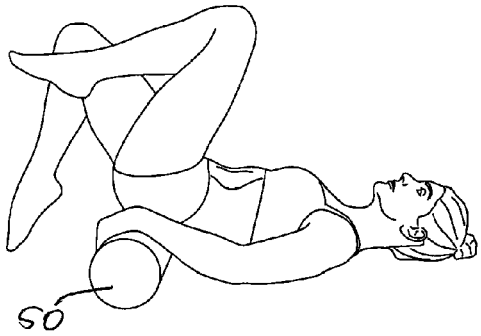
FIG.37-A
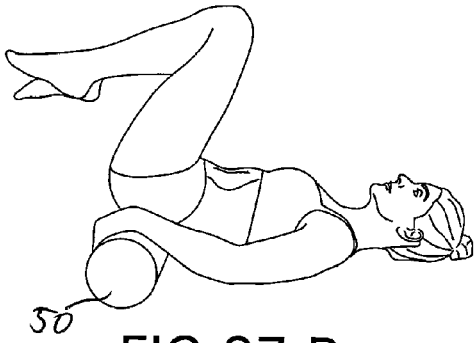
FIG.37-B
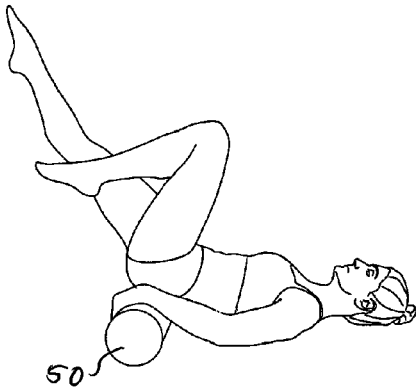
FIG.37-C

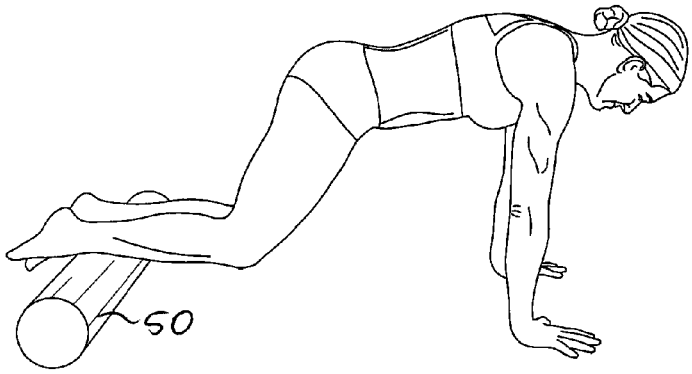
FIG.39-A
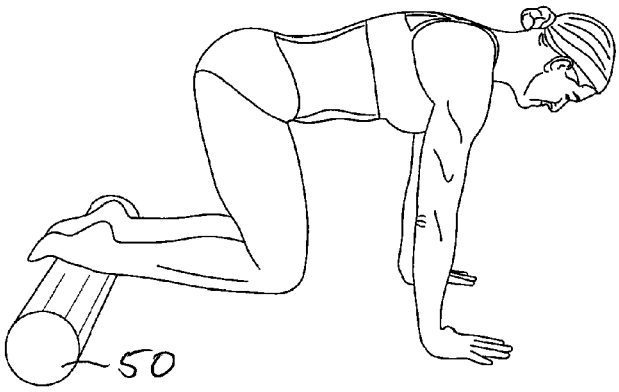
FIG.39-B

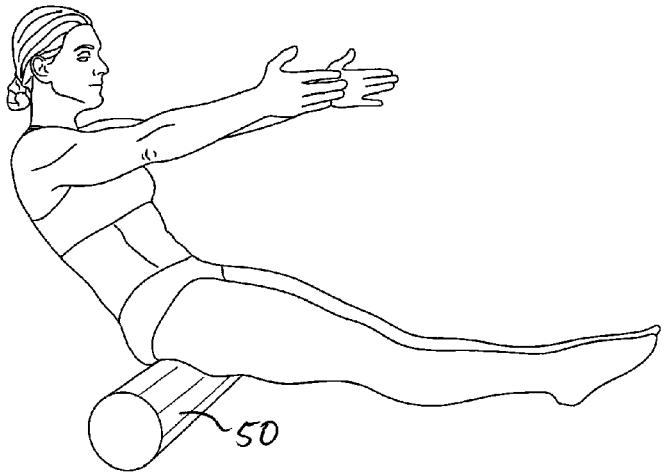
FIG.41-A
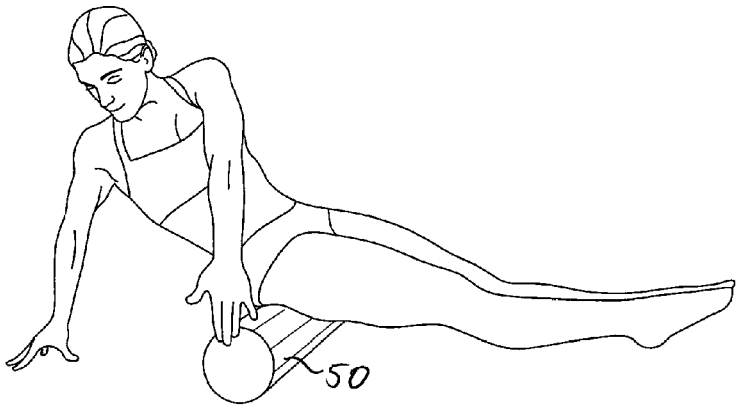
FIG.41-B

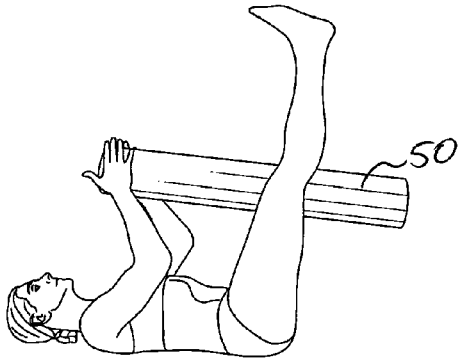
FIG.42-A
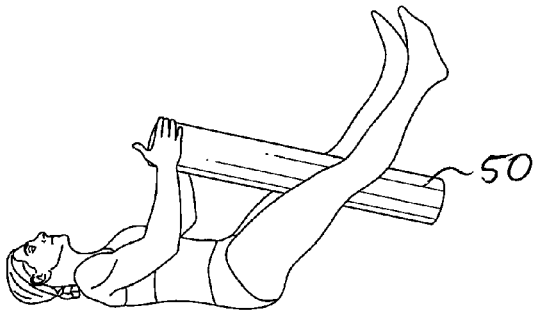
FIG.42-B
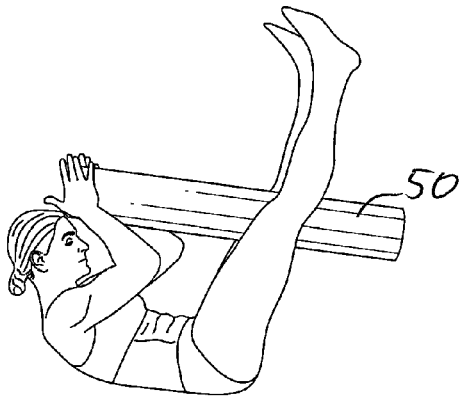
FIG.42-C

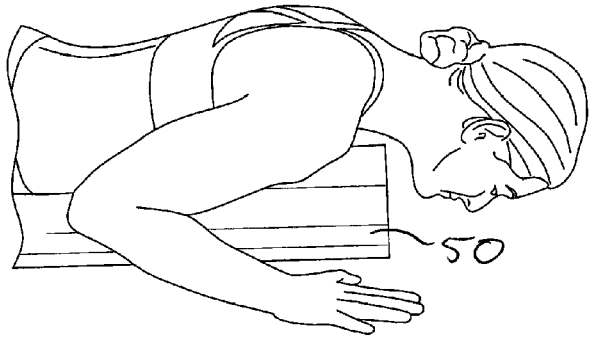
FIG.44-A
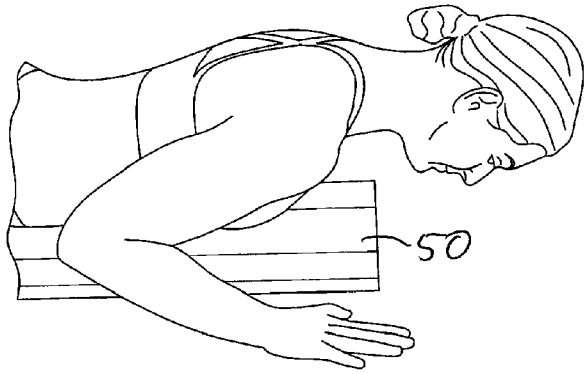
FIG.44-B (SECTION A-A)

SYSTEM AND METHODS FOR PROMOTING HEALTH

CROSS REFERENCE TO RELATED APPLICATIONS

The present application is a continuation of U.S. patent application Ser. No. 11/729,083 filed on Mar. 26, 2007, now abandoned, which claims the benefit of Provisional Application Nos. 60/785,746 and 60/838,755, filed on Mar. 24, 2006 and Aug. 17, 2006 respectively, the disclosures of each of which are expressly incorporated herein.

FIELD OF THE INVENTION

The present invention is directed to systems and methods for promoting health, and provides an easy-to-learn method for improving one's alignment, posture and body health. The systems and methods of the present invention, in accordance with various embodiments thereof, will improve flexibility, function, and performance while reducing the risk of injury, and provides techniques that open, lengthen and create comfort for better quality of everyday life.

SUMMARY OF THE INVENTION

The systems and methods of the present invention, in accordance with various embodiments thereof, may increase the quality and longevity of upright posture; coordination and balance; bone mass and joint range; mobility and flexibility; function, integrity and length of muscles; and may reduce general muscle fatigue and ache, joint ache and swelling, ligament strain, and recovery time.

The present invention, which includes the M.E.L.T. method or techniques (described in additional detail below), is a gentle group exercise technique designed to improve the body's postural alignment, joint range, local muscle hydration, bone density, and even wrinkles and cellulite, so that we can stand, sit and move with greater comfort, energy, and elegance. As we age, our attitude, emotions, physical injuries and habitually held postures aggregate into what we call "getting old." The present invention, e.g., the M.E.L.T. Method, effectively turns back the clock by improving the myofascia, a connective tissue of the body, reintegrating its liquid state, promoting tissue tone and integrity. Using a Pro-foam roller and small hand and foot balls, a system is provided for creating and accessing space in the myofascial layers resulting in effects similar to those from rolfing or neuromuscular therapy. The feeling of length and connection to the inner workings of the body and improving the longevity and quality of your upright posture may be experienced.

Conventionally, traditional muscular training and flexibility programs have been employed to try to correct these problems. Many people utilize stretching exercises as a remedy for stiffness and aches. However, these muscular training efforts, although beneficial on many levels, do not always address these issues as well as previously thought. A person's aches, stiffness and current body tone may be caused by another component of the body. Muscles move and stabilize a person's body, but what really holds a person together, creating and maintaining the longevity of structure and function, is connective tissue known as fascia. New studies and research have identified the fascial system as a responsive, living tissue that can be improved and maintained by external forces. Fascia, however, just like all systems in the body, also can become less responsive and lose its tone and ability to function through the aging process. It can also be degraded by a person's lifestyle and daily wear and tear. Everything from sitting for 8-hours a day to the activities one regularly engages in can affect a person's structure and ability to function properly. Research on connective tissue intervention has shown that the systems and methods of the present invention, in accordance with various embodiments thereof, e.g., the M.E.L.T. Method (Myofascial Energetic Length Technique), can improve the integrity and longevity of a person's connective tissue and reduce the common signs and unwanted affects of aging. The books and concepts currently out on the market regarding foam rolling have outdated techniques and very little understanding of why this type of intervention is so effective and necessary to maintain a person's structural integrity and reduce body aches and pain. The systems and methods of the present invention, in accordance with various embodiments thereof, are backed by the most recent fascial research, and the techniques have been proven effective in benefiting the potential for a person's body to endure gravity, aging and the environment over a lifetime.

All fascia is connective tissue but not all connective tissue is fascia. There are many types of connective tissue in a person's body. In the present invention, e.g., the M.E.L.T. Method, focus may be to affect the liquid layer between the deep fascia and the muscles. This layer is called myofascia. Myofascia is this connective tissue within and around muscle. The present invention's focus on the fascia and myofascia will change the way we approach a person's health and wellness. Once thought to be only a container like substance, research has confirmed that fascial tissue contains nerves, smooth muscle cells, and is responsive to a person's autonomic nervous system. It has the ability to contract independently of muscle contraction. Concepts such as "passive muscle stiffness" are now being researched to see if it could be considered "passive fascial restriction" or an issue with fascial responsiveness and tone. A person's connective tissue is now recognized as the dynamic, living system that provides us with a person's structural form. "Myofascial pain is one of the most common causes of musculoskeletal pain in medical practice." (Imamura, Fischer, Imamura et al. 1997). Pain from myofascial dysfunction is at the source of many painful symptoms such as joint pain, inflammation, and a reduction in normal function and alignment. The National Institute of Arthritis and Musculoskeletal and Skin Disease (NIAMS) historically had based much of its research on biomechanics, is now confirming that the fascial system can have a direct relationship to tissue repair, and the integrity and longevity of muscle responsiveness. In the February 2004 issue of *Time Magazine*, it was reported that, "[i]nflammation is at the core of Alzheimers, cancer, and other disease." The industries of health and wellness are looking for any product or technique that will reduce inflammation.

Fascial research has opened up another door in the pursuit of pain relief. Working within the fascial system persons now have the capabilities to reduce inflammation in joints, improve postural alignment, increasing mobility and stability within a person's joints, and reduce common musculoskeletal issues that are incurred due to injury or from the aging process.

Many of the methods that are chosen to stay fit, lean and strong can degrade a person's structure. If a person looks at a bodybuilder, although they have a muscular physique, many have reduced flexibility and joint range due to their strong muscles. If that same bodybuilder used the systems and methods of the present invention, in accordance with various embodiments thereof, in conjunction with their muscular training, they may gain the same muscular benefits without greatly reducing joint space and range.

Using the OPTP Pro-Foam Roller, 55/65 cm physio-balls, and 6 1-2 cm firm and soft balls, over 60 movements can be learned to strengthen, lengthen and improve one's body's overall tone and responsiveness. The systems and methods of the present invention, in accordance with various embodiments thereof, is a simple technique, but more importantly, it is effective and has immediate results.

As people age, they shrink, wrinkle, and lose space between their joints, thereby causing those joints to ache, in turn and causing discomfort. But the effects of an injury, the aging process, and one's overall well-being can be greatly improved with the systems and methods of the present invention, in accordance with various embodiments thereof, which may allow the freedom to feel younger and more energized every time a person gets treated, or "melted." This method also helps in reducing unsightly cellulite as it rehydrates the very tissue that, when dehydrated, cannot maintain its tone. This innovative technique compliments any exercise practice a person does and creates a sound platform to improve one's posture, alignment and body tone.

In 2004, nearly 800,000 foam rollers were purchased by individuals and health care practitioners in the US and Europe (Frost and Sullivan). As a common tool used in physical therapy, the foam roller has been on the market for nearly 20 years. The foam roller has been improved since its creation, however, the understanding of why this tool is effective in improving balance, structural integrity and reducing pain is not widely known. The systems and methods of the present invention, in accordance with various embodiments thereof, provides an explanation to the foam roller's effectiveness and holds new techniques that have more immediate results and longer lasting effects. The systems and methods of the present invention, in accordance with various embodiments thereof, focuses on the connective tissue rather than muscle during rolling and provides simple "Rules of Rolling" that help the participant learn proper technique for added benefit. The foam roller is now seen in most health clubs and many people currently own one as a home exercise tool.

The systems and methods of the present invention, in accordance with various embodiments thereof, may be a part of any training, exercise or rehabilitation program. It contains information that should be more recognized as an element to enhance a person's body longevity. This information has been missing in the fitness, therapy and rehabilitation arenas. This method does not replace any exercise or rehab program, rather it creates a more stable platform to work from, making any technique more sensible and effective. The systems and methods of the present invention, in accordance with various embodiments thereof, gives people a way to easily and effectively help themselves and see results instantly from the techniques.

The present invention, according to an embodiment thereof, may relate to a method or system for at least one of increasing the quality and longevity of upright posture, coordination and balance, bone mass and joint range, mobility and flexibility, function, integrity and length of muscles. Alternatively or additionally, the present invention, according to an embodiment thereof, may relate to a method or system for at least one of reducing general muscle fatigue and ache, joint ache and swelling, ligament strain, and recovery time. The method may include the step of assessing an alignment condition of the body. The method may also include the step of stimulating fascial tissue in the body by applying one or more of a roller and a ball to the fascial tissue in a predetermined direction so as to address or correct the alignment condition.

BRIEF DESCRIPTION OF THE DRAWINGS

FIG. 4-A is a perspective view of an individual demonstrating the assessment of the arm lines, in accordance with the present invention;

FIG. 4-B is a perspective view of an individual demonstrating the assessment of the arm lines, in accordance with the present invention;

FIG. 4-C is a perspective view of an individual demonstrating the assessment of the arm lines, in accordance with the present invention;

FIG. 10-A is a perspective view of a demonstration of back techniques, in accordance with the present invention;

FIG. 10-B is a perspective view of a demonstration of back techniques, in accordance with the present invention;

FIG. 10-C is a perspective view of a demonstration of back techniques, in accordance with the present invention;

FIG. 14-A is a side view of a demonstration of leg techniques, in accordance with the present invention;

FIG. 14-B is a side view of a demonstration of back techniques, in accordance with the present invention;

FIG. 17-A is a perspective view of a demonstration of leg techniques, in accordance with the present invention;

FIG. 17-B is a perspective view of a demonstration of back techniques, in accordance with the present invention;

FIG. 17-C is a front view of a demonstration of pelvic techniques, in accordance with the present invention;

FIG. 20-A is a perspective view of a demonstration of pelvic techniques, in accordance with the present invention;

FIG. 20-B is a perspective view of a demonstration of pelvic techniques, in accordance with the present invention;

FIG. 20-C is a perspective view of a demonstration of pelvic techniques, in accordance with the present invention;

FIG. 20-D is a perspective view of a demonstration of pelvic techniques, in accordance with the present invention;

FIG. 21-A is a perspective view of a demonstration of lengthening techniques, in accordance with the present invention;

FIG. 21-B is a perspective view of a demonstration of lengthening techniques, in accordance with the present invention;

FIG. 22-A is a perspective view of a demonstration of pelvic techniques, in accordance with the present invention;

FIG. 22-B is a perspective view of a demonstration of leg techniques, in accordance with the present invention;

FIG. 24-A is a perspective view of a demonstration of pelvic and leg techniques, in accordance with the present invention;

FIG. 24-B is a perspective view of a demonstration of pelvic and leg techniques, in accordance with the present invention;

FIG. 24-C is a perspective view of a demonstration of pelvic and leg techniques, in accordance with the present invention;

FIG. 26-A is a side view of a demonstration of pelvic and leg techniques, in accordance with the present invention;

FIG. 26-B is a side view of a demonstration of pelvic and leg techniques, in accordance with the present invention;

FIG. 27-A is a side view of a demonstration of pelvic and leg techniques, in accordance with the present invention;

FIG. 27-B is a side view of a demonstration of pelvic and leg techniques, in accordance with the present invention;

FIG. 37-A is a side view of a demonstration of abdominal techniques, in accordance with the present invention;

FIG. 37-B is a side view of a demonstration of abdominal techniques, in accordance with the present invention;

FIG. 37-C is a side view of a demonstration of abdominal techniques, in accordance with the present invention;

FIG. 39-A is a side view of a demonstration of abdominal and back techniques, in accordance with the present invention;

FIG. 39-B is a side view of a demonstration of abdominal and back techniques, in accordance with the present invention;

FIG. 41-A is a side view of a demonstration of abdominal and back techniques, in accordance with the present invention;

FIG. 41-B is a side view of a demonstration of abdominal and back techniques, in accordance with the present invention;

FIG. 42-A is a side view of a demonstration of abdominal techniques, in accordance with the present invention;

FIG. 42-B is a side view of a demonstration of abdominal and back techniques, in accordance with the present invention;

FIG. 42-C is a side view of a demonstration of abdominal and back techniques, in accordance with the present invention;

FIG. 44-A is a side view of a demonstration of neck techniques, in accordance with the present invention;

FIG. 44-B is a side view of a demonstration of neck techniques, in accordance with the present invention;

DETAILED DESCRIPTION

Figure 1:
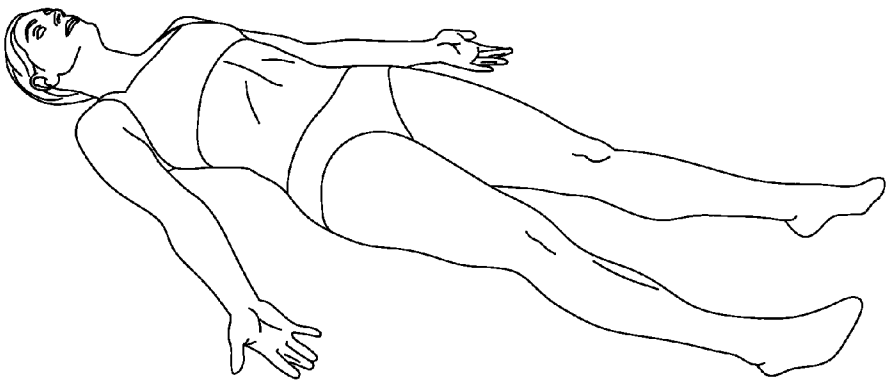
FIG. 1 is a perspective view of an individual practicing the anatomical zero position, in accordance with the present invention.

The present invention, stems from the concept that posture, in its most ideal form, occurs when a body effortlessly maintains an upright position against gravity. When all of the joints align at their centers, there will be minimal compression, inflammation or compensatory action for any motion, thus distributing the weight throughout the entire structure. It is an objective of the present invention to assist in providing clarity about a body's current functional state and providing techniques to improve the integrity and longevity of that body both in function and structure.

The present invention may provide an integrated approach to learning the body better. Longevity and integrity of a person's body depends on balance, both outside the body and within. This methodology is based on the embodiment and application of anatomical, physiological and developmental principles and the role of fascial continuity. Combining a variety of movement integration techniques, movement potential is explored to enhance alignment, mobility and stability and decrease the risk of injury and dysfunction.

Before a person can truly change their body and sense the change, they have to know where the body's current status. The cornerstone of the M.E.L.T. METHOD is the teaching of self-assessment. Improvement of a person's ability to sense their body is a gift. Improving proprioception, balance, and tensegrity will help a person sense when they are compromising their own body and adjust more often to reduce external force deformation, thereby helping the body's longevity and ease.

One aspect of the present invention is referred to as Strength Integration. Age, society, gravity and environmental states dictate most of a person's postural and repetitive habits that reduce the amount of body tone needed by an individual to maintain good alignment over a lifetime. Through a specialized series of integrated movement patterns and postures this technique is designed to reinforce the maintenance of ideal joint alignment and muscular timing in everyday life. These techniques decrease the risk of injury, increase tone and preserve joint tissue, function and structure. Using different props and equipment, each lesson becomes a new challenge for participants. The three basic parts of Strength Integration are differentiation, muscular timing, and movements designed to increase pelvic girdle and shoulder stability and alignment.

Another aspect of the present invention is referred to as Length Adaptation. Flexibility and length of muscular tissue is vital in maintaining ideal alignment. However the tone of fascia and its continuity within the body has a far greater impact to the body's structure over a lifetime. The present invention teaches movement exploration within a variety of specialized lengthening and assessment postures and techniques. The present invention teaches participants how to gain movement potential, access space and reduce the risk of injury by maintaining harmonious tension relationships within the body. The present invention is designed to bring awareness in maintaining the longevity of mobility and ideal alignment for a lifetime. The three basic parts of M.E.L.T. Length Adaptation are the hand and foot series, the lengthening techniques, and the whole body melting techniques.

If aging were merely an aesthetic issue, remedies could be limited to cosmetic creams, makeup and surgeries. However, bone loss, joint degeneration, organ dysfunction and a myriad of physiological, chemical, hormonal and nutritional changes occur due to aging. Everywhere around the world, there are researchers, labs, clinical studies, both in the medical field and the health and wellness industries searching for ways to reduce the effects and/or signs of aging. Unfortunately, the focus has been on the bones, skin and muscles. Even with all of the new advancements in science, it has yet to be figured out how to stop the unwanted affects of aging. Recent fascial research is now showing some exciting news on the effects of aging and is shedding light on how people may be able to slow down the "shrinking process" and loss of space caused by aging and lifestyle. With all of the time science has spent figuring out how to reduce bone loss by looking at bones, it may be more valuable to look at the tone and responsiveness of fascia as a means in reducing bone loss and deformation of a person's postural alignment.

It is not the bones or muscles that give a person's body its shape. While bones serve as spacers and muscles move and stabilize us, it is a person's fascia that creates a person's structure and connection. Fascia is everywhere. It connects and separates things to give the things inside of us an identity and autonomy as well as providing accessible space for things to move. This tissue is overlooked and greatly misunderstood by both the medical, wellness and health industries. The nutrition, medical, fitness, and wellness industries are billion dollar industries. The fascial research industry is a miniscule portion thereof. With the new findings of fascial responsiveness and its ability to change and adapt to external forces, this system is now budding and striking up some notoriety.

It is important to take adequate time to learn, understand and have sound intention in the usage and teaching of this method. This method is not static. As with all theories and learning of the human body, they will constantly change and develop, expand and correct itself as science confirms more and more how the body maintains its function over a lifetime. The present invention can be utilized by individuals of any age and general activity level. It can also be used by those who are pregnant, post-surgery, overweight, injured, inexperienced, and those who may have limited mobility.

Another aspect of the present invention is a vibrating roller device. The vibrating apparatus, when used in combination with the rolling, strengthening, and lengthening techniques described herein, will benefit the fascial and myofascial tissues and receptors. Usage of the present invention will have positive effects on the muscles, posture, alignment, joint range, and can confer various other benefits to other bodily systems.

The present invention can be practiced by an individual on his own body, or a practitioner may practice the present invention on a subject by instructing and/or aiding in proper positioning and techniques as described herein.

Usage of the present invention will improve a user's flexibility, muscle tone, posture, alignment, range of motion, overall well being, improve sleeping patterns and increase the effectiveness of other exercise programs. The present invention, e.g., the M.E.L.T. Method, will reduce body aches, pains, wrinkles, cellulite, tension, headaches, risks of injury, and signs of aging.

Where to Begin

The first step in utilizing the present invention is making an assessment of an individual's posture and alignment. Frequently, an individual is not aware of their own postural misalignment and dysfunction. Many people believe that if these alignment issues existed in their body, they would be in pain. However, a person can be completely dysfunctional and out of alignment and not feel any major pain. The present invention can assess a person's posture and function by using simple scientific measurements and barometers.

Ideal posture is more of an idea than a real thing. Joints and bone alignment are the core of what ideal posture "looks" like. It should also be considered when determining how posture "feels." Standing with ideal posture is more than a physical action of alignment and the corresponding effect on the human structure. A person's posture is an accumulation of every day, every instance of a person's existence. It is a blending of how a person deals with, flows with and reacts to the environment, both internally and externally, as well as consciously and unconsciously. The way we stand has a great deal to do with a person's emotional state. Depression, abuse, lack of self esteem, poor body image can all contribute to a forward head carriage or slumped shoulders. To the same extent, a person who walks around with his or her chest stuck out and shoulders thrown way back has an emotional component that sends them out into the world with this posture.

A person's brain is responsible for sending the signals of pain in order to alert the individual when something is wrong. However, pain is not necessarily a sign of dysfunction. So with one's entire history in consideration, let's see how much a person can feel by utilizing barometer #1.

Barometer #1: Anatomical Zero

This is a basic position to use as a barometer for improvement. Before starting any part of the M.E.L.T. series, a subject will lay on the floor in the anatomical zero position. See FIG. 1. Notice what the subject does and does not feel on the floor. It will soon be learned how to sense the masses and spaces more clearly. But for now, notice behind the ankles, knees, low back, shoulders, neck and wrists. The practitioner of the present invention should take notice of whether those body parts touch the floor or if there is space between them and the floor. Finding space is not a bad thing. It is important that the practitioner does not try to change anything, but simply tunes into what can be felt about how a subject lays in that position. It should be noted if the subject feels tension in any particular areas, if the their breathing is affecting their position, if the subject is feeling balanced from one hip to the other, and from one shoulder to the other. An additional thing to notice about the subject's body in particular is the bottom rib region. Take note if the ribcage feels as if it is sticking up towards the ceiling. The practitioner should also observe if that part of the spine feels excessively curved and lifted. If so, this is one specific postural detail that the practitioner of the present invention is going to fix. This is a very common position for many people to have and is easy to change with the right movements, focus and connection.

Barometer #2: The Plumb Line

A second barometer may be better carried out with the aid of a camera (digital if possible). If a person has access to a tripod, all the better for accuracy, and for the most specific assessment, a practitioner of the present invention can create a plumb line by tacking a piece of string to the ceiling and having it dangle just above the floor. Tie a couple of keys or a comparable weight to the bottom of the string to weight it to gravity and a functional plumb line is created.

The Plumb Line of the Body

Figure 2:
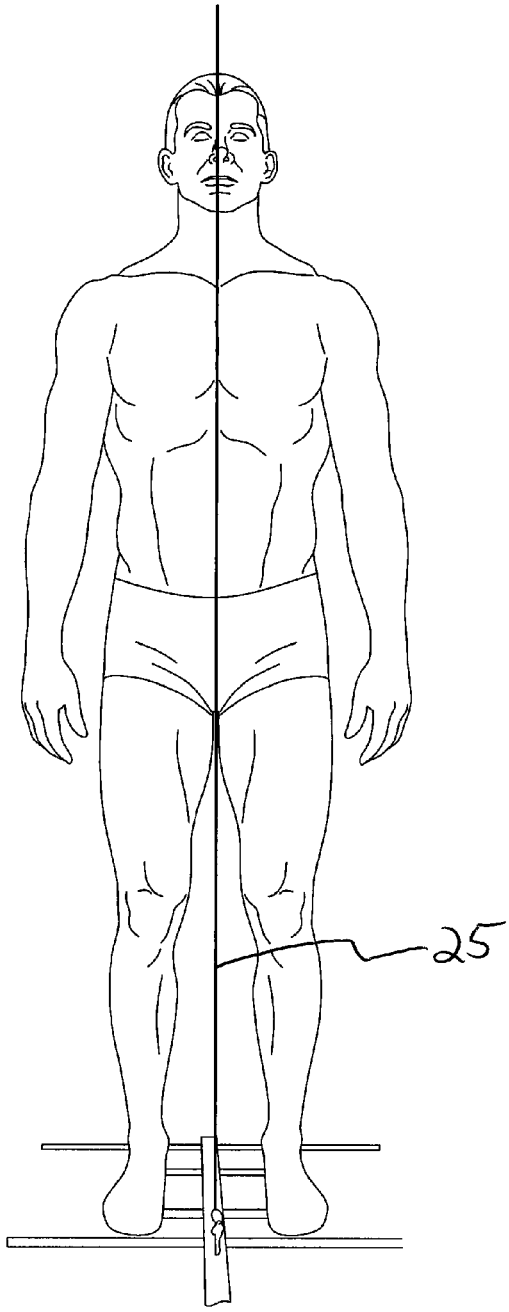
FIG. 2 is a perspective view of an individual assessing posture and alignment by use of a plumb line, in accordance with the present invention.

The plumb line is used to represent a line of reference in a standing position. It is a line that starts at the ceiling and is perfectly vertical. The only fixed point in standing posture is at the base where the feet are in contact with the floor. The standing positions may be regarded as the composite alignment of a subject from four views: front, back, left side and right side. It involves the position and alignment of many joints and parts of the body. It is not expected that any individual should match the standard in every respect. A person's alignment can be off of the perfect plumb line and the person may never feel pain. But if joints are being compressed or are incongruent, that is usually when pain occurs. See FIG. 2.

Profile View of Spine and Bones

The cervical vertebra (neck region) curves inward slightly and goes anterior to the plumb line of the body.

The thoracic vertebra (mid-back) curves just slightly backwards or posterior from the plumb line.

The lumbar vertebra (just above one's pelvic bones) curves inward and goes anterior to the plumb line.

The sacrum (tailbone) curves just slightly backwards or posterior and the tip curves back in slightly.

And the coccyx is the tip of the sacrum. It is the last bone on the spine. (Many people have chipped, broken or deformed their coccyx and never know about it until they went to a body worker who checked it.)

Barometer #3: Assessment

The best way to change one's body is to first know what it presently looks like. A third barometer of the present invention involves a photo session that will allow a practitioner to evaluate a subject's progress.

Four photographs should be taken to illustrate the front view, both sides and the rear view. If a practitioner made a plumb line 25, it may be easily seen if a subject is standing upright or where a subject has issues with postural alignment. See FIG. 2 for an example of the front view. The figure illustrates an individual's assessment photos, wherein, for this particular subject, the chest and back muscles are so over developed from all of the years of weight training his shoulder joint is internally rotated (a person can see the back of his hands in the picture) and his entire shoulder girdle is protracted or moving forward.

Ideal alignment exists when the plumb line side view through the lower extremities (hips and legs) passes slightly behind the center of the hip joint. The plumb line should be slightly in front of the axis of the knee joint and the ankle (malleolus) joint and should go through the apex of the arch of the foot. Subtle deviations off of anatomical zero are a part of life. A person's environment both internally and externally can affect the alignment of a person's body. It is believed that the closer a person's joints line up at their centers, the more optimal the movement will be that is created by a person's joints. It is possible that a person's imbalances may rebalance each other out. So even though an individual has a slight difference in structure, he may not have any tendency for that deviation to create extreme compression to the spine or joints, and therefore will not have any sites of pain. A body can get quite far off from anatomical position and still move around. For example, an elderly person is able to move around even if his back is so curved that it causes him to hunch forward. This illustrates that a person can get quite out of alignment, but still move, although that movement may not be very efficient. Sometimes it is where and how a body misaligns that will determine if pain will be a factor. Simply, if the joints line up more congruously, there is less risk that the joints will become inflamed or degenerate. If there is no abrasion occurring at the joints, there should not be any damage.

Determining if one's pelvis is anteriorly or posteriorly tilted and how much angular displacement a person has is truly beyond the ability of an average person to ascertain. Determination of the causes of an individual's misaligned posture may take a more objective opinion. It is usually analyzed by a professional bodyworker such as a Rolfer, structural integration specialist, or biomechanic specialist. The present invention however, will allow the user to observe his own, or his subject's misalignments. More importantly, he will be able to feel the body in a different, more connected way so that the user of the present invention can make the appropriate changes accordingly.

By utilizing the initial steps of the present invention, a practitioner should now have a sense of what the individual's posture looks like, so a next step may be to assess how a person stands when the person is not thinking about holding one's self up.

Barometer #4: Grounding and Rooting

In this step of the present invention, a person stands in front of a mirror with his feet hip distance apart and eyes closed. The natural movement of one's body is noticed as well as the ability to maintain balance. It should be noted whether balance is achieved effortlessly, if any tension is sensed in the body, and if the person is relaxed. The person's footing should also be observed to determine whether the person tends to stand more on his heels or on the balls of the feet. It should also be noted whether a person stands more heavily and grounded on one foot versus the other, and whether the person stands more on the inside of his feet or the outside. A general sense may be gotten of how the person's body feels in a standing, yet relaxed position. The person can then open his eyes and observe his posture. Misalignments may be easier to observe when a person has tuned into their grounding and rooting.

Barometer #5: Make a List of the Things and Activities a Person Engages in Frequently The activities that a person engages in frequently and daily have a substantial impact on that person's bodily structure. The more often a particular activity or movement is conducted, the more impact it will have on the person. If a person sits at a desk all day long, a person may find his pelvis tucked under and forward from the plumb line in his pictures. If a person is a pitcher in baseball, a person might notice his right shoulder is more forward from the front and profile pictures, and that person may side bend more to the right than to the left. These are common patterns that alter a person's natural postural alignment. Attempts to correct these types of imbalances by holding temporary compensatory postures may result in putting additional strain on a person's body. The natural flow of a person's body is altered and that person is no longer maintaining his natural stance. Use of the techniques described in the present invention will lead to a more effective remedy to those imbalances.

The Fine Details of Posture and Alignment

In a model of the human skeleton, the joints line up at their centers. This position is referred to as "anatomical zero." It is a standard anatomical description defined as the reference point for "ideal alignment." This idea presents a purely mechanical model allowing scientific study for range of movement by measuring the range motion (known as angular displacement) associated with two human body portions (e.g., the upper arm and the lower arm) connected to a common joint (the elbow). In other words, it allows us to define optimal range of motion for any joint. In some science books, it is even called "normal range," but in today's time, the "average" is in fact, below normal. With two-thirds of the American population overweight, over-medicated and underactive, the majority of people are working below what science would define as "normal" function.

To only use science and definition to assess a body would limit the ability to enhance that body's movement potential. The concept given by "traditional" anatomy and physiology separates movement into segmented functions, failing to give a picture of the seamless integration seen in the living body. The human body also has muscles, organs, and connective tissue, among other things, which have a direct effect on the skeletal system, and creates the responsiveness found in dynamic movement. It is within the fascial tissue that we connect all of these parts and create a living being.

To understand how one's body maintains its structural and functional integrity, a person would think some complex systems would have to be well recognized and understood. It would help to know all about a person's body. However, if the user could learn a few basic landmarks and some assessment techniques, that's all a person would need to know to get started to change one's body for the better. Before a person begins to melt one's fascia and improve one's structure, it is important to learn about the practical theories of M.E.L.T., techniques specific to M.E.L.T., and the Rules of Rolling to help a person value the changes and feel the effects of working with this fascia.

This portion of the present invention focuses on fascial responsiveness for the preservation and integrity of joints in terms of their positions and functions. The goals are to access the connection between the mind and the body, and to learn more about how one's body works in order to maintain a balanced, optimally functioning system for a lifetime. The practitioner begins by working with and accessing the connective tissue of the body known as fascia, specifically the myofascia, superficial fascia and deep fascial structures. To define anatomy and ideal function, science separates the parts allowing for definition to occur. In doing so, the seamless integration and connection found within the living body and the study of this connective system failed to flourish for many years. The present invention provides tools that can be used at home and that may add to a person's lifestyle to aid in their own "personal maintenance" of their body. The following techniques have proven successful and powerful results in reducing everything from joint ache to syndromes such as plantar heel pain, TMJ, and chronic fatigue. These techniques should be used as an "add-on" to any strength or cardiovascular training, rehabilitation programs or injury protocols.

The present invention, e.g., M.E.L.T. lengthening techniques, may create a distinct change of tone in both fascial and muscular tissue so the benefits are far reaching. The focus of this concept is on improving movement potential and ease, not muscular strength or size. We focus on structural strength and the integrity and longevity of the structure. Over a lifetime, achieving this with moderate effort is the ultimate goal.

A person's connective tissue is made up of many layers. Due to its complicated composition, it is difficult to understand the integral, organic nature in which a person's body is able to exist and function. It is important to take care of the tissue if we expect the functional purpose and role that connective tissue may uphold to continue functioning normally over a lifetime. This is the premise upon which the present invention, e.g., M.E.L.T., is founded upon. While there are many fascial connections, e.g., thousands of connective lines from many muscles, the general understanding is that the inner world of the human body is all connected.

The present invention provides a system and method of learning the body in a better way to improve a body's organic potential to effortlessly maintain a balanced, connected internal environment that will endure, blend and adapt with its external environment throughout the aging process. Longevity and integrity of a person's body's systems (structural, chemical, hormonal, nutritional . . . all of them . . . both separately and as a unified whole) are dependent on the balance and connection to both environments. This invention is based on the embodiment (connection) and application of fascial continuity and how a person's connection to it may help us to maintain ideal alignment, joint range and a person's structural integrity. This connection may be defined by the mnemonic device, "Body S.Q.U.A.R.E.$^{2}$" The concept is "to enhance the Structural Quality of a human body (postural alignment, balance, joint function) a person may Understand and become more Aware of their body's natural Adaptability, Repetitive patterns and how they Execute movement in the External Environment from day to day as well as take into consideration the internal Environment of a body from day to day. This creates a sounder mind-body connection and increases a body's alignment, function and longevity.

Masses and Spaces

Figure 3:
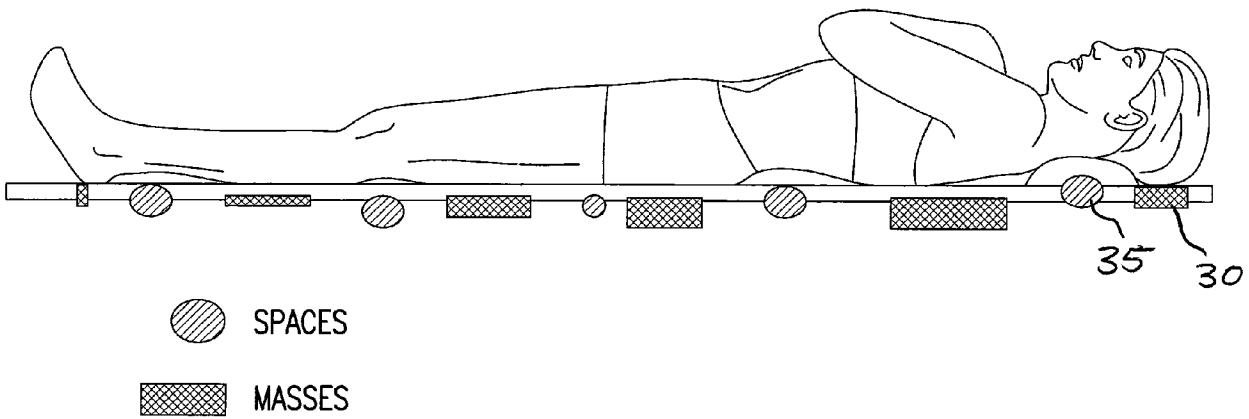
FIG. 3 is a side view of an individual demonstrating assessment of the masses and spaces, in accordance with the present invention.

The present invention may relate to "masses and spaces". It describes the head (cranium) as a mass, the throat (neck) region is a space, the thorax (rib region) is a mass, the belly is another space, and the pelvis is also a mass. See FIG. 3. The ability for a person to move one's arms and legs depend upon some relationship concepts of the masses 30 and spaces 35. We may connect strength within the spaces so we can move the masses 30 with ideal range. We may also find mobility and stability within the masses 30 to access the spaces 35 that we have. Every day we age and with that comes degradation. The first thing most people lose as they age is space. Once we lose space, the masses are too close together, joint range is reduced, inflammation begins and myofascial pain most often becomes a result of this effect. The M.E.L.T. techniques may help to reduce these effects and help to maintain longevity of a body creating an anti-aging effect.

Differentiation

People have a hard time doing this. To learn proper coordinated patterns, we may learn how to move from one mass or space of the body at a time. To differentiate the thoracic movement from the scapular movements (we call this scapulo-thoracic rhythm), pelvic motion from thoracic motion, and moving the pelvis instead of the leg (we call this pelvi-femoral motion). Being able to differentiate the masses and move them independently is essential in maintaining the natural balance of upright posture so no one joint is compromised during normal function.

Domes and Arches of the Human Body

The present invention describes the body as a system that moves with connection through its dome and arch support. The human body has many of these, for example, the feet have three arches, the pelvis is an inverted dome, the diaphragm is a dome and is sometimes referred to as the diaphragmatic arch, the pleura of the lungs are domes, the roof of the mouth and the parietal bones or crown of the skull are also dome shaped. It is a vital part of a person's balance and stability that a person's arches and domes stay optimally curved, strong and flexible to endure all of the changes we live through day after day.

Two-Directional Lengthening Techniques

When length is discussed, the present invention is referring to the spaces between a person's anatomical structures. Moving in two directions like we do when we play "tug-of-war" and the teams are balanced perfectly in their strength. There is a constant state of length maintained.

Tension Relationships

When optimal balance is maintained and all of the joints line up at their centers, optimal structure and function are maintained. It is the balance of parts that have opposition to maintain their homeostasis that is most important. For every action in the body, there is a reaction.

Navel to Spine or Contacting the Core

These techniques will teach people how to connect to their core musculature and deep fascia. This improves a person's neural connection to balance and stability so that we may move with coordination and ease. The basic concepts of maintaining stable spine, rib and pelvic positions are taught as we try to contact the stabilizing mechanisms of the core. This is a valuable technique to proficiently execute both the strength integration and length adaptation series of the present invention, e.g., M.E.L.T.

M.E.L.T.—Rules of Rolling

Care should be taken when using a roller. Some things to take into consideration include:

1. Age

As we age, tissue becomes less uniform as space increases between fibers, yet decreases in joints. This program of the present invention is suitable for a person of any age, however, if a user is over the age of 65, extra caution should be taken while rolling. If osteoporosis, osteopenia or any other bone degeneration or dysfunction is present, the duration a person should lay directly on the roller while conducting lengthening techniques should be limited. A maximum of 5-8 minutes supine on the roller (spine running the length of the roller) is recommended.

Once the maximum time has expended, roll off of the roller and reconnect to one's grounding by laying flat on the floor in the anatomical zero position. See FIG. 1. Take approximately 1-2 minutes off of the roller before returning. While rolling, be sure to support one's body weight as best as a person can. A person may even roll over two rollers at a time to reduce the pressure over any specific area that may be excessively restricted.

2. Body Composition

If a person is very thin, extra caution should be taken while rolling as one's tissue may be tightly adhered to surrounding tissue. This happens as we age, but it is also a consideration for a subject with a very thin body, whether male or female. If a person is overweight, more time should be taken with the rolling as there is simply more to sink into. Move more slowly and be patient. It is important not to be aggressive with melting or rolling techniques.

3. Pain Tolerance

Rolling tissue either with a profoam roller or by a rolfer may create deep sensations for the receiver of this treatment. However, the theory that it should hurt to the point that it gives a person true pain is not the goal. The goal of this exercise is to 'wake up a little something" in the tissue. It is important not to over stimulate the tissue or send it further into spasm or contraction. Be patient and specific when rolling. Smaller surface areas require slower, more isolated rolling. The ultimate goal is not to "sweep" the entire leg in one roll. If the roller 50 is too hard to allow for proper sinking and melting to occur, roll the profoam roller up in a yoga mat 70 or towel to reduce the intensity of the fascial release techniques.

General Rules Involving Rolling

1. Laying Supine on the Roller

After 8-10 minutes on the roller, it is recommended to come off and lay supine in the anatomical zero position on the floor to allow one's body time to recognize what is happening and to adjust to any changes that may have occurred while on the roller. It is also a good idea to do this for one's conscious awareness to sense what is changing as a person does this work.

2. Directional Rolling

The present invention may provide specific rolling sequences and techniques. A person may learn how to roll specific regions of the body. When a person rolls on one's own, the person can do a full body M.E.L.T. or a person can isolate just one area at a time. There is no obligation to roll from head to toe every time as a person will achieve the lasting benefits of this technique regardless of what is rolled.

3. Rolling Duration

Rolling on any "primary myofascial line" for too long is not recommended. Less is more with fascial rolling. One to three passes down any line is typically sufficient to reintegrate and improve the liquid state of this tissue. Fascia fiber releases more globally with slow, low load pressure over longer duration. So instead of rolling over one's iliotibial band 8-10 times, it would be better to move more slowly over the tissue, meet the barrier, work with shearing techniques, and finally taking a pass through the line if the intensity is tolerable. Spending up to 3 minutes to prepare one's self to roll one time fully down the leg. Take adequate time and wait for tissue compliance, spreading and release signs. Using an analogy of a person's fascial tissue being a sponge, as a person rolls over a fascial line, water is being pressed out of the sponge. Once a person is finished with the line, the body naturally refills the tissue with more water. This improves the liquid state of the fascia and improves collagen quantity, tone, and continuity. As one's tissue becomes more hydrated, the intensity will diminish and a person will find less restriction, adhesions or barriers.

The MELT Fascial Rolling Techniques

The present invention may help to improve myofascial integrity and responsiveness. Some techniques of the present invention that a user will learn include:

Melting

When a practitioner of the present invention is lengthening tissue, rolling or strengthening, the focus is on whatever part of the body the roller is touching. A user may allow the body time to melt directly on the top of the roller. One's body weight may stay on top of the roller to reduce any excessive pressure to the extremities. A user can also use props such as an extra roller, yoga block, towel, pillow, or ball, or simply roll on a matted or rugged area. The more a person intentionally presses into the top of the roller, the more one's body will melt and blend into the surface. This allows not only superficial fascia, but the deep fascia to respond with every roll, lengthening technique or strengthening movement a person completes.

Directional Rolling

The present invention may use specific rolling sequences and techniques. During this course, a person will learn how to roll specific regions of the body. When a person rolls on one's own, a person can do a full body M.E.L.T. or a person can isolate just one area at a time. There is no obligation to roll from head to toe every time as a person will achieve the lasting benefits of this technique regardless of what is rolled.

If time permits to do a full rolling series, it is recommended to begin with the pelvis as it is the keystone to both a person's balance potential and stabilizing mechanics.

Shearing Techniques: There are 2 Types of Shearing Techniques.

1. Direct Shearing Techniques

This is when a person maintains a focal point directly on top of the roller and moves one's body over the roller from left to right or side to side. The roller does not move. Rather, a person moves over the roller in one localized place. This allows us to mobilize the tissue layers and stimulate the interfaces between the deep fascia and the muscle to allow proper glide-ability between the layers.

2. Indirect Shearing Techniques:

This happens more often in the areas where there are crossing muscular fibers or muscular fibers that attach to more than one insertion. For example, the hamstrings or lateral hip have overlapping fibers that take more pinpointed rolling to release. We also create shearing by maintaining a focal point and moving at a distal joint. For example, on the IT band, we meet a barrier and shear the tissue by bending and straightening the knee as we move slowly into the barrier.

Barriers

As the Primary Lines are moved through, the legs may be worked up and down. There are many layers of fascia and muscle. There is a high risk of tissue becoming distorted, tight or restricted and create tension in localized areas. As the leg is rolled, the fascia is compressed and its water content is reduced. During movement, where there is a lack of fluidity, the tissue sort of "bubbles" and creates a barrier that would be painful to roll over. Instead of blasting through the barriers, it is desirable to "meet the barriers" and explore their movement potential. As the tissue complies, a person will be able to move further down or up the line a person are rolling. The more a person rolls, the less barriers a person may find. Once a person can roll down any line just a few times with little to no sense of barriers, a person can assume one's fascial tissue is in an ideal, fluid, mobile state.

Meeting the Barriers

When we roll down the leg, we begin by "meeting the barrier." This means as a person rolls, the person will encounter areas of restriction, bundling, and adhering fibers. When a person meets the barrier, a person introduces lateral rolling to shear the tissue and melt deeper into the fibers to reintegrate the liquid state of the connective tissue. That area is worked upon for a minute or two by creating movement of the leg such as bending the knee or flexing and extending the ankle to create movement in the tissue. Once a person has worked in the area where the barrier began, return to the beginning position and roll down again. This time moving into the barrier, working with shearing again.

If the tissue is so restricted that a person passes one's own pain tolerance, the user should go back to "meeting the barrier." Then, a person may return to the beginning position one more time and make one clean sweep through the tissue. The user may then move on to another line. It is preferred to make only one full pass over any line one time. It is preferred that one does not roll over tissue like a steam roller or as if a person were vacuuming a rug.

Anatomical Zero

Body assessment in the anatomical zero position (see Barometer #1 and FIG. 1) is an important component of the present invention. Before starting any lengthening technique in the series, it is best to begin in this position and when a person finishes one's exercise, return to see if a person notices any changes.

Techniques of Differentiation

Pelvic Mobilization: Anterior/Posterior Tilting

1. Position

Figure 6:
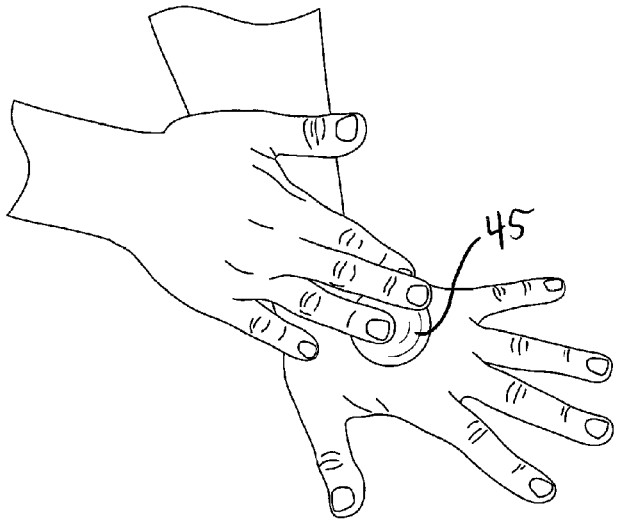
FIG. 6 is a perspective view of a demonstration of hand techniques, in accordance with the present invention.

On the roller, a person may lay on one's back, with one's pelvis off of the end of the roller as seen in FIG. 6-B. The person may bend one's knees and place both feet on the floor. In the center of the buttocks are one's sits-bones. This is the bottom of the pelvis. One's heels are in line with the sits-bones in this exercise. Visualize where one's sits-bones are and put one's heels in that line, one's feet are about a 12-16" away from the end of the roller. One's shins should be perpendicular to the floor or as close to that position as a person can get. Ribs remain heavy and anchored throughout the exercise. Think of reaching one's knees over one's toes to create this position. One's feet should have equal pressure from toe to heel, and left to right throughout the exercise.

2. Focus

The user should breathe in and out three or four times until the person feels one's spine sink into the ground. Spinal position is important. It is desired to maintain and create more length in the spinal column (specifically the space in the lower lumbar and sacrum) and stop some of the passive contraction that may be present in the spinal muscles at rest. Breathe into the lungs with a three dimensional breath. Let the ribs open to the sides, from top to bottom, and from floor to ceiling. One's focus is on relaxing through the movement in both directions. The main muscles that initiate the movements are the deep abdominal muscles, rather than a person's gluteus, chest or leg muscles.

Neutral Pelvis: this is a position in which the anterior-superior spines of the ilias are in the same transverse plane and in which they and the symphysis pubis are in the same vertical plane.

Anterior Pelvic Tilt: this is a position of the pelvis in which the sits bones move wide and the lumbar curve slightly increases (top of pelvis tilts forward over pubis). One's tailbone releases towards the floor as the arch occurs. Think of sending one's sits bones towards one's heels. The low back is not compressed; rather it is lengthened in this position in its natural curve. Think about sending one's thighs away from the hip sockets. Use one's hands to assist the sensation of the movement in the hips by holding on to one's hipbones and pull them together slightly. This position is associated with hyperextension of the lumbar spine and flexion of the hip joints. The rib cage stays on the roller during the movement. It will want to thrust to the ceiling when a person does the anterior tilt.

Posterior Pelvic Tilt: this is when a user lengthens his spine by approximately 10-degrees and the pubis bone moves towards the nose. It is important not to "mash" the lower back to the roller by contracting the chest, protracting the shoulder girdle or hyperextending the neck. It is also important not to squeeze the gluteal muscles together. Instead, the transverse abdominals and spinal flexors should be used. Think of lengthening the lower lumbar or flattening it just slightly (looks like a "tucked" pelvis). Think of moving the pelvis like a rocking chair. The abdominal muscles should do the work, and the gluteal muscles should not be involved with this exercise.

These pelvic positions are essential to learn and recognize, as they will become an integral part of many exercises. A person will see the words "10-degree posterior tilt throughout the range of movement" or "a slight anterior tilt remains throughout movement" frequently. Learning to recognize these positions and learning where the movement comes from will be helpful to the practice of the present invention.

This is one example of the system and method of the present invention, e.g., the M.E.L.T. Method, as it would flow in a group exercise class or in a one-on-one training or done as a learning series. Each line has been described and broken down into techniques specific to that line. However, this technique can also be done as a flowing, progressive sequence moving in and out of each line with smooth transitions. The techniques however, remain the same.

The goal of the present invention is to achieve more space within and between the masses so that the masses can access more space. If the masses get too close together (or too far apart) in any direction, they will also move further away (or closer together) from each other in another direction to maintain the relative balance of the body structure as a whole. This is a natural autonomic response of the body. We will assess the distance between the masses and spaces by using Barometer #1: Anatomical Zero.

Anatomical Zero

This is a basic position to use as a barometer for improvement. Before starting any part of any M.E.L.T. Method, the subject should lay on the floor in the anatomical zero position. See FIG. 1. Notice what a person does and does not feel on the floor. The masses are touching the floor, and the spaces are not. Notice how much space a person has. This is one time a person can actually have too much space. Do not try to change anything. Just notice how one's body rests. The practitioner should pay attention to the masses of the body, specifically head, shoulder blades, $12^{th}$ rib, pelvis, and heel positions.

Now that a person has an idea of one's masses and spaces, the person's breath may be focused on with a simple technique called a 3-dimensional breath breakdown. This technique may be used to lower a person's sympathetic tone and tune into the diaphragm, and its relationship to one's masses and spaces.

Three-Dimensional Breath Breakdown

This is an exercise to bring awareness to the diaphragm's fascial connection and movement. It is a powerful muscle for both breathing mechanics and core stabilization. The role of the diaphragm is to maintain optimal intra-abdominal pressure during high and low loading of the core and provide postural support during movements of the core. Its role is essential during respiration as it contracts during inhalation thus altering organ and muscular positions. Its contraction changes both the intra abdominal pressure and lung volume. If the diaphragm is in dysfunction, the core is severely compromised.

The roller is placed behind the knees and a person may tune into the diaphragm's relationship with one's body's tone and responsiveness. Once in the position, focus on breathing, spinal position and the general tension in the body. Begin by breaking down a three dimensional breath. A person can work with one's breathing by simply breaking down a 3-dimensional breath. It is helpful to imagine one's trunk as a 6-sided box. On an inhale, allow one's diaphragm to expand this area from: front to back, and then from side to side (even under the armpits), and one more direction from top to bottom or collarbone to the pelvic floor. Notice how breathing affects the relationships between the masses and spaces.

Now that the practitioner of the present invention has an idea of what the subject's body feels like, the next step is to begin affecting the primary fascial lines of the body. As set forth above, fascia creates continuous bands and layers to connect each individual part of a person's system to its surrounding parts. These lines define the concept of a model rather than describe the continuity of a person's fascial body. As with any science, to break down the content into "anatomy" (cut up pieces) it is possible to more easily describe the "container-like structure" and identify each piece to ultimately express the connection of the parts.

There are 6 primary lines discussed herein. They include The Arm Lines, The Superficial Back Line, The Superficial Front Line, The Spiral Lines, The Lateral Lines and The Deep Core Line. The pull of each line is powerful enough to distort postural alignment if it is not balanced with the other lines.

The Arm Lines

Restrictions in the arm lines can create dysfunction in the mobility of the shoulder girdle as well as affect the placement of the pelvis during the gait cycle. This technique is far reaching and can be done before or after working out, yoga or cardio exercise.

The arm line is actually involved in many distinctive myofascial meridians that run from the axial skeleton to the four sides of the hands. Given their multiple links, the arm lines have a significant effect to the mid-back and shoulder positions. These images are used simply as a representation to create a working model for the MELT technique. Using landmarks and beginning evaluation positions can help a person to see one's progress. When working with the hands and feet, often times people have lost range of motion in their joints and don't even know. Once a person has affected the connective tissue and proprioceptors, a person will immediately see a change in range of movement. This technique helps with flexibility, strength and integrity of the hands and feet.

Assessing the Arm Lines

To begin affecting the myofascial arm lines, the hand and shoulder series may be performed. First, we explore the length and accessibility of the arm lines by assessing the range of motion found in the joints of the wrist and elbow.

Begin in a quadruped position, fingers facing forward. We can assess the superficial front arm line and one's wrist flexion by gently rocking forward and back. Notice if there is any pain or inability to work in this position. See FIGS. 4-A.

Now turn one's hands outward so the thumbs face forward and rock forward and back again assessing the range and ability to perform the movement without pain or restriction.

Finally, see if a person can turn one's arm entirely around until the fingers face a person. See FIG. 4-B. If a person can turn one's hands around, see if a person can bend the elbows. Once a person has explored the elbow range, lean back to one's heels slowly rolling one's hands off the floor, pressing the fingers away from a person.

Now we will assess flexion of the wrist and the superficial back arm line. Place the back of the hand on the floor, fingers facing inward. The entire back of the hand should be able to touch the floor if the wrist can fully flex. Gently lean from side to side, keeping the elbows straight, and note how it feels. If there is no pain or restriction, turn the fingers towards the person, and then all the way around until the fingers face outward. Again, rock from side to side, slowly moving the wrists together as far as possible and gently bend the elbows and roll the hands off of the floor from wrist to finger. See FIG. 4-C.

The Hands Series

Similar to the feet, the hands are a person's gateway to the world. Releasing the hands can help reduce carpal tunnel syndrome symptoms as well as symptoms such as stiffness or pain at end range due to the aging process and overuse. The balls can be used on a table at work, the floor, a wall or even in between the hands to allow for tissue release. The photos demonstrate the techniques on the floor, but feel free to try this technique in different areas to see what works best for a person. The hand is not only comprised of motor organs. Rather, it is a sensitive, accurate sensory receptor feeding back information essential for its own performance. It is responsible for the development of visual appreciation by allowing cross-checking of information.

The Technique:

To improve the quality and integrity of the hands and arms a person will advantageously use 3 types of small balls.

There are two soft 2-cm balls. These are used to learn the various rolling techniques. There are landmarks and position points used to mobilize the joints, direct or deep rolling techniques used to affect the deep fascia, indirect or friction rolling techniques to stimulate the superficial fascia and proprioceptors of the hand. The two small 1 cm balls are used to mobilize the joints and explore positions points such as the eye of the hand, the long bones of the fingers, the thenar eminence or thumb pad, and the joints of the fingers. In the hand we can work with direct and indirect rolling but on the feet the little ball is not rolled.

The two larger 2 cm firm balls are used for direct and indirect rolling techniques. Although there are no true arches of the hand, the resilience and buoyancy of the palm is vital in maintaining strength and mobility of the fingers. This ball truly mobilizes the deep fascia. We will also use these balls for exploring the fascia found between the two forearm bones.

We begin learning the landmarks of the hand with the 2 soft 2-cm balls (the larger, squishy ball).

Figure 5:
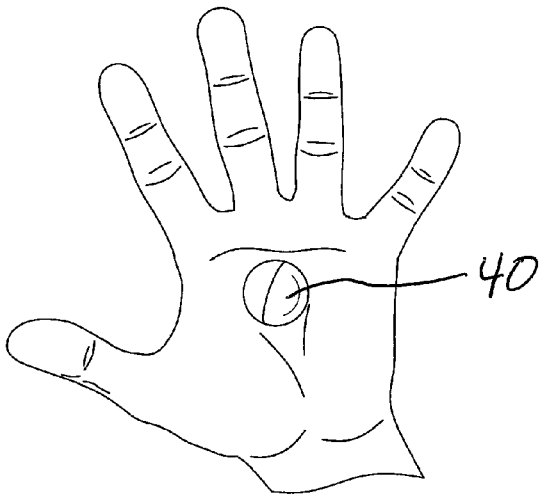
FIG. 5 is a front view of a demonstration of hand techniques, in accordance with the present invention.

Begin at the eye of the hand. See FIG. 5. This is the center of the palm. Gently press some of one's body weight into the balls 40. For this part we roll both hands at the same time. When we work with the firm 2 cm ball 45 we will roll one hand at a time for fine tuning.

Next, explore the long bones of the fingers. Be sure to stay in the palm. We will work the fingers separately. Press into each one and notice how it affects the wrist and hand.

Then mobilize the tissue under the thumb pad. This is called the thenar eminence. Small circles and short rolling are used around the base of the palm and thumb. Now try using direct rolling. This is a one-direction rolling technique. Begin in the fingers and firmly roll all the way to the base of the palm one area at a time. Finish with friction rolling. This is a much lighter, random rolling technique.

Now that one's proprioceptors are stimulated, try using the small 1-cm ball. It will feel much different than the soft ball. This ball is used for joint mobilization and shearing techniques to affect the different layers of fascia. Repeat the techniques a person used with the 2 cm soft ball. Press firmly into the eye of the hand. Then move up to the top joint of the long bones of the hand. A person should still be in the palm and not on the fingers. Press each one separately. If a person looks at the back of one's hand, a person should be able to see the joints lift slightly. Move to the thumb pad and wrist using small circular and lateral rolling to shear the tissue layers. Direct rolling can also be used with the small ball to affect the deep fascia.

A person can mobilize the finger joints and stimulate circulation in the fingers with the small ball by placing it in between each finger and gently squeezing the balls near the finger joints.

Now we work with the larger 2 cm firm ball. Work with the hands separately, one hand at a time. The same techniques apply beginning at the eye of the hand but this time we work with the deep rolling. Small circles at the center of the palm, then down to the thumb pad and wrist and slowly roll down the underside of the forearm from wrist to elbow to affect the tissue between the forearm bones. Finish with some friction and direct rolling over the entire palm.

Rolling on the Dorsum of the Hand

With the soft 2-cm ball 45 a person can roll directly over each finger, the top of the hand and in-between the fingers. Squeezing the ball 45 in the hand and between the fingers is also a great technique. A person can try rolling the fingers with the smaller ball in the same way. See FIG. 6.

Let's reassess the arm lines as we did before. In a quadruped position, palms faced down, fingers forward, rock forward and back. Does the wrist have more range? Turn the thumb forward and try again. Now turn the hand all the way around and see if a person is able to bend the elbows and gently roll the hands off the floor.

Check the flexors of the hands by placing the palms faced up fingers inward and rock from side to side. Then turn the fingers outward and try again to rock from side to side and slowly bend the elbows and roll off the hands.

The Shoulder Series

Now we explore the shoulder joints and range of motion with the Shoulder Series.

The shoulder series affects all of the arm lines and improves their relationship to the neck and rib positions. Oftentimes, people with neck and shoulder pain have restrictions in the arm lines reducing joint space and congruity. A person can go back and do a quick body scan by laying on the floor and see how one's masses and spaces lie. See FIG. 1.

Basic Rules of the Shoulder Series:

Since a person is laying directly on the spinous processes, the person preferably only lies on the roller for a maximum of 10 minutes. This entire series should take a person approximately 8 minutes to complete from beginning to end. If a person wants to spend more time on the roller, it is recommended doing one phase of the series, rolling off of the roller and resting on the floor for a minute and then return to finish the series. The OPTP profoam roller is softer and more forgiving than the traditional white rollers but again, a person is directly on the spinous processes and sending an overwhelming amount of neural information to one's nervous system. Be gentle and focused when doing this technique. We may again tune into the masses and spaces of a person's body.

Now come up and lay the length of the roller from head to tailbone. Make sure a person can touch the flat surface of the roller under one's pelvis. We will use this as an assessment position in a minute. This is one's first opportunity to truly feel one's spine. When we lay on the floor, the practitioner of the present invention is really feeling a person's masses of the head, ribs and pelvis. We never really lay directly on the spinous processes. Allow one's body to melt into the roller and notice one's ribs and pelvis. These masses should stay stable and rested as we try to move a person's arms in an ideal range.

Figure 7:
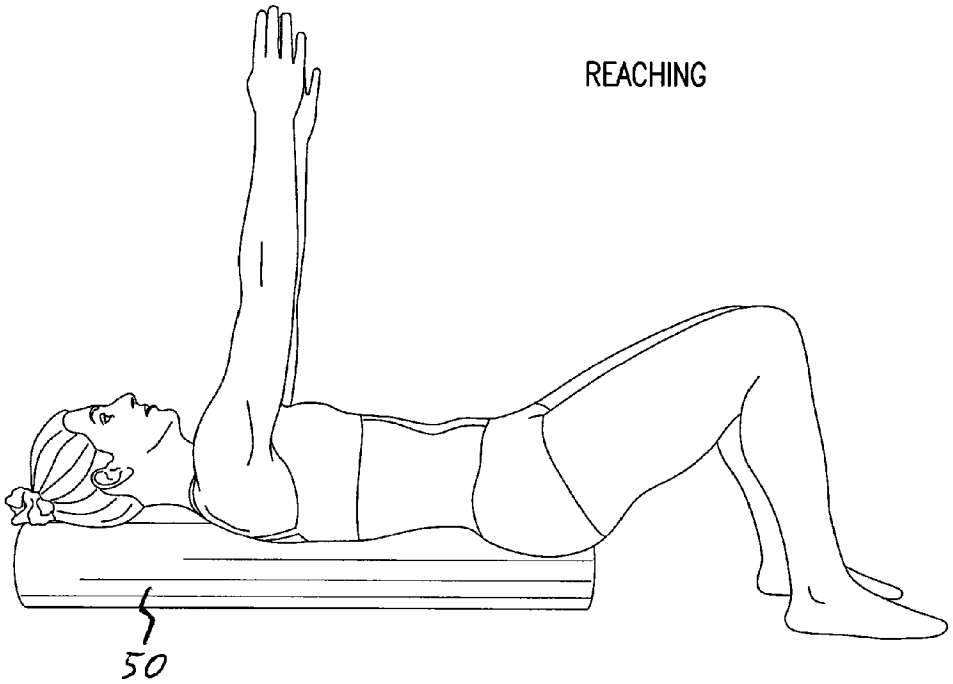
FIG. 7 is a side view of an individual demonstrating the shoulder series techniques, in accordance with the present invention.

There are four arm positions a person will move through. First position is with the arms up. See FIG. 7. Try to sense the skeletal weight of one's arms and allow the shoulder blades to wrap around the roller 50. Notice if a person shrugs to do this. If a person does, try sending the shoulder blades downward towards one's hips as they wrap around the roller. Keep the arms energetically alive, not limp and soft. The energy may move from the spine all the way out to the finger tips.

Figure 8:
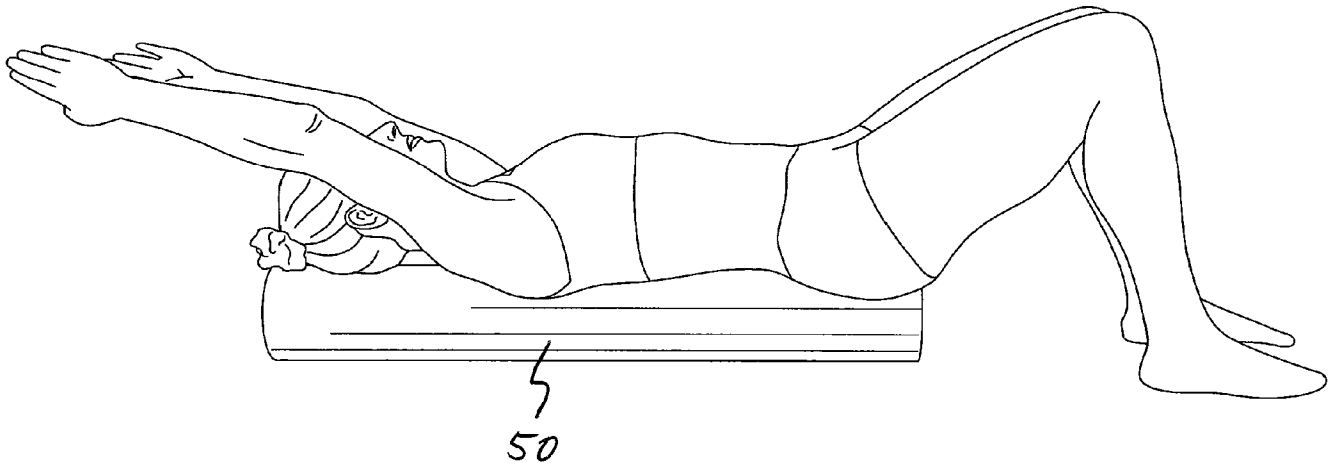
FIG. 8 is a side view of an individual demonstrating the shoulder series techniques, in accordance with the present invention.

Minimal effort, maximal range. Notice one's rib region as well. It should remain heavy during this series in its entirety. A person will return to this position over and over again so connect to it now. Maintain one's navel to spine to engage the deep abdominal wall. This will help to keep one's ribs in place as a person move to position two. See FIG. 8.

Bring the arms overhead until one's upper arm is along side of one's ear. Do not drop one's arms to the floor. That range of motion would require a change in the spine and ribs and would lose the integrity of the fascial connection. Notice the position of one's ribs and make sure to focus on keeping the ribs in the same place. Remember, the arm lines originate at the spine and ribs. The origins may be anchored if length is to be achieved down to the fingers. Now slowly bend the elbows and move one's arms to a third position.

In third position the elbows and shoulders bend to a 90-degree angle along side the body, and the forearms are parallel to the floor. Again, don't drop the arms below the roller and touch the floor. Maintain the integrity of the arm lines and focus on energetically moving the elbows directly laterally away from one's body. A person may experience a very mild fuzzy sensation in the arms. This position will stimulate a connection to one's neural fascia as well. Bring one's arms to a prayer position and then move the arms into this position to check one's alignment and form.

Finally, zip up the arms beginning at the arm pits and slowly move to $4^{th}$ position. The arms should now be at the sides, palms faced up, but arms should not touch the floor.

Repeat this series of movement a few times, slowly increasing the speed that a person moves. A person should hear no clicking or grinding in the shoulder or feel any pain. If a person does, a person may learn to work in one's range of motion, which may be smaller than the ideal range of the shoulder joint.

Now we will try a single arm reach. In opposition, the arms move overhead. Let the thumb lead the movement, then the back of the hand and finally the pinky finger to affect all of the lines of the hand. Make sure one's ribs are still neutral on the roller.

Next, we create a double arm reach. Begin in first position and then reach the arms out to the side as if a person were going to create dance space. Don't lock out the elbows, shrug the shoulders or drop the arms past shoulder level.

Maintain an energetic arm, tuning into all of the joints of the arm, hand and fingers. Now floss the nerves by alternating flexion and extension of the wrists in opposition. This shears the fascial tissues around the nerves, muscles and bones.

Finally, we work with the neck. Keep one's torso balanced in the middle of the roller and gently move only one's head to one side of the roller. One's ear should still be above the roller in this position. Do not hyperextend one's neck to lengthen the connective tissue. This is the superficial back arm line that connects from the skull to the back of the hand. Once a person has one's head anchored, reach one's opposite hand to the bottom of the roller and gently press one's fingers into the roller. See if a person can sense the connection up in one's neck and shoulder. This is called closing the container.

Now open the container by releasing the hand first and then returning the head to the top of the roller. Try this on the other side. Notice if one side is shorter or more restricted than the other. Maybe on one side a person has a hard time touching the roller but on the other side, a person found the bottom of the roller easily. Try each side a second time. Don't stay in this position for more than four or five breaths before opening the container and releasing the line.

Don't turn the head, drop the head back and compress the cervical vertebrae, or move the ribs to move the head. In doing so, a person reduces the arm line connection. It is just a simple side bending of the cervical vertebrae to contact the deep and superficial front arm lines.

A person is contacting the fascial fibers from the back of the skull and ear line down past the attachments to one's collarbone and shoulder blade to the fingertips.

Now a person is ready to slide off the roller. Begin with the buttocks, then lower back, followed by the ribs and finally one's head. The person should again lay flat on the floor in the anatomical zero position. See FIG. 1. The masses and spaces should be reevaluated. The person should also note if he senses more surface area resting on the floor and how the spine feels? Note if the person feels more relaxed than when the person started. What a person is sensing is the liquid state of the fascial fiber. This improves joint mobility independently of muscular strength or tone.

The Feet

As we age, it is often not back pain that is most debilitating, but foot pain that reduces activity in older adults and begins a more sedentary lifestyle. With all of the time spent staying active, some should be taken to take better care of a person's feet if they are to last a lifetime. Flat feet, fallen arches, bunions, neuromas, general swelling, and poor circulation are all caused by misuse, overuse and age. Although hereditary components may play a factor in a person's bone structure, most of the damage seen in the foot is caused by a person's day-to-day use of them. Poor fitting shoes and high heels can cause deformation of the toes, arches or surface of a person's feet. Just like the hands, the four primary myofascial lines create a container of support for the various aspects of the foot. This container enables communication to occur up the connective chain of the body. This simple foot series can aid in maintaining the integrity and mobility of the feet and help to create a more stable base of support.

Begin with a simple test of foot mobility and one's ability to maintain balance and body position. Stand with one's feet hip width apart. See if a person can come up onto the balls of the feet focusing on the ball of the big toe. Then, maintaining an upright posture, try to bend the knees slightly, lower down to one's heels to assess lower leg synergy and then stand tall again. Try this a few times.

The Technique:

Step 1: The 2 cm soft ball. If a person is just starting out with this technique a person might be surprised as to how tender and sensitive one's feet are. This soft ball introduces release potential without over stimulating the peripheral nervous system. Remember, one's feet hold the nerve endings to a great deal of one's system. Start with the soft ball. If there are any current foot dysfunctions on the participant, be careful not to over roll the tissue. The small ball may not even be used the first few times the participant tries the technique.

Figure 9:
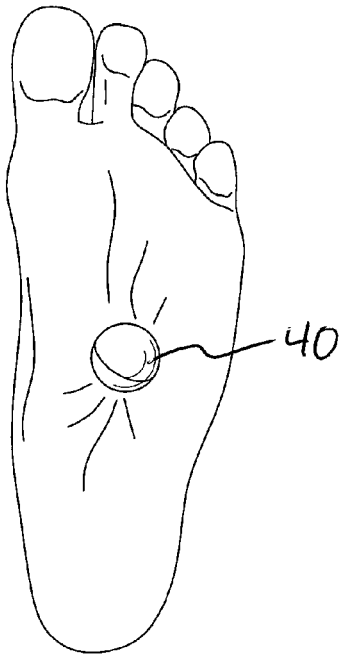
FIG. 9 is a front view of a demonstration of foot techniques, in accordance with the present invention.

The Eye of the Foot:

This is the starting point when practicing the present invention on the foot. First, see if a person can stand directly on the ball 40 at the eye of the foot. See FIG. 9. If standing is too much, feel free to sit on a chair and take some of one's body weight off to begin. A person may also find it helpful to do this near a table or wall for added support. As a person stands on this focal point, sense the foot melting over the ball like a piece of warm taffy. Slowly a person will feel the ball sink into one's foot, releasing tension all the way up the leg. Lightly press some of one's body weight into the ball. Try drawing one's heel towards the ball and imagine trying to "suction" the ball off of the floor. This mobilizes the arches and stimulates their buoyancy.

Now move the ball under the ball of the big toe. Just like the hands, a person will mobilize the long bones with specific position point pressing. The ball should be under the foot base and not the toes. Stimulate the three arches. The transverse arch under the long bones, the medial arch and the lateral arch. Press the ball just above the heel bone and work to mobilize the joints located between the many foot bones.

A person can also work with direct rolling techniques beginning at the long bones and moving from toe to heel in long deep pressure movements. A person can also use this ball for friction or indirect rolling to stimulate the plantar fascia and reintegrate its liquid state.

Finish the foot with a few parabolas under the heel and the various joints and bones of the foot. Sweep the ball laterally just before the heel and directly over it. Small circles can also be made. Do not be excessive with one's pressure on the ball when in the heel. Less is usually more.

Notice if a person has trouble balancing or maintaining one's upper body alignment as a person moves through this assessment. If a person has difficulty moving easily through this range, one's feet and base of support need help.

We can now mobilize the joints of the feet with the small 1 cm firm ball. This ball allows a person to position point areas of restriction surrounding joints, specifically, the long bones of the foot. Begin at the eye of the foot. Light pressing motions can be done now with the smaller ball. However, one preferably does not roll on the little ball, as it is desirable to wake up a little something in the deep layers of the foot but not to irritate the plantar fascia by working to deeply. Work under each long bone of the foot may be performed separately as well as mobilizing the medial arch and the lateral arch. A person may also mobilize the joint between the heel bone and the various foot bones. Now try the same movements on the other foot. The eye of the foot, the long bones, the arches and the joint of the heel bone.

Finish the foot series with the firm 2-cm ball. This ball may release the arches of the foot and improve the connection to the primary fascial lines of the body. Begin at the eye of the foot. Keep one's heel on the ground as a person presses into the foot. Now move to the transverse arch. The ball is placed just below the ball of the big toe. Moving the foot laterally with the heel firmly on the ground, a person may work with as much pressure as can be tolerated. Notice if one's toes rise upward toward the ceiling. Try to allow the toes to curl towards the ground, sensing that the foot is melting over the ball. Now begin to affect the arches with the deep directional rolling. Work under the medial arch and the lateral arch. Slower movements are more beneficial with the deep rolling. Try using the friction rolling with this ball as well. Finish the foot with a few parabolas by sweeping the heel laterally over the ball. Now try these techniques on the other foot. A person has successfully stimulated the primary lines of rolling and may now begin affecting the primary fascial lines with direct rolling techniques.

The Superficial Back Line

If a person is working with a full body MELT, a person can move right from the shoulder series to the upper back rolling of the superficial back line. If a person is doing this line as a class, begin at the pelvis. Begin by rolling on the sacrum and pelvic area. See FIG. 10-A. When a person rolls around the pelvis, a person may use smaller movements but the same rules apply as in any M.E.L.T. rolling techniques. Move slowly and focus on pressing more heavily as a person roll towards the leg and lighten up as a person move to the spine. Be mindful of one's shoulders and how much pressure a person put on one's arms. Use one's legs to roll forward and backward.

Next, put one's knees and feet together, lean one's legs to one side and roll on just one side of the pelvis and sacrum. This is called the SI joint or sacroiliac joint. It is the space between the pelvis and the tailbone. This movement is especially helpful for post-pregnancy hip issues or lower back pain as this area can often times be either too compressed or too loose. This technique can help both issues. Move in small ranges. If a person finds a sensitive spot, wait, melt and then begin rolling again. Now try it on the other side. Roll from left to right or forwards and backwards to mobilize and shear the tissue.

Move onto one's upper back but again, be mindful of one's position. One's legs do the work. As a person rolls to the head side of the roller, curl one's body upwards and maintain a strong pressure into the roller. As a person rolls towards one's legs, do not let the knees go too far over the ankle line. Move one's feet as a person goes. See FIGS. 10-B.

Now rest the pelvis on the floor, tucking posteriorly (low back is elongated) as a person extends one's ribcage only over the roller. Keep one's neck supported and long. See FIG. 10-C.

Finish the upper back line by rolling down to the base of the skull or occipital base. Keep the pressure directly on top of the roller and move one's head side to side. Stay on one side and nod "yes" to mobilize one side at a time.

Return to the sitting position on the roller. Move to the right side of the roller until one's right buttocks is off the roller entirely. Roll down the leg so person is now sitting on the upper leg and the pelvis is now on the backside of the roller.

Figure 11:
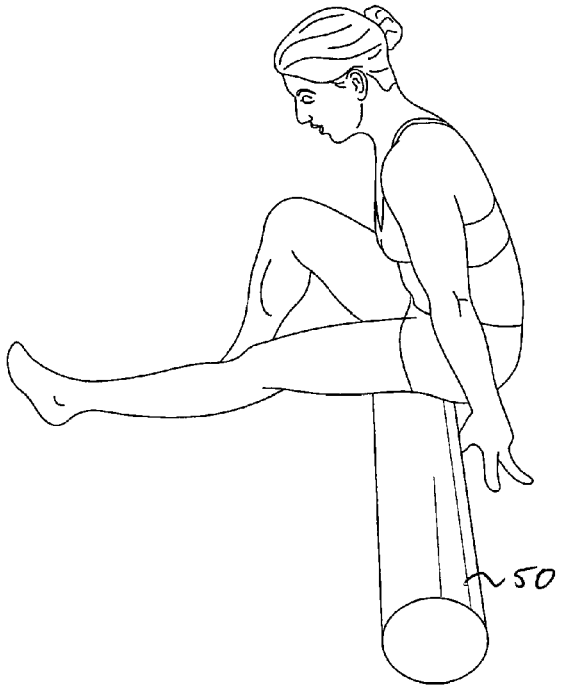
FIG. 11 is a perspective view of a demonstration of leg techniques, in accordance with the present invention.

Create small rotations with the leg to shear the tissue between the hamstrings then apply pressure to one's leg and roll down the thigh until sitting behind the roller. Now roll the calf on the same leg with the same movements, slow, rotation and forward and backward rolling. Now return to the sitting position and try the entire thing on the other side. See FIG. 11.

Figure 12:
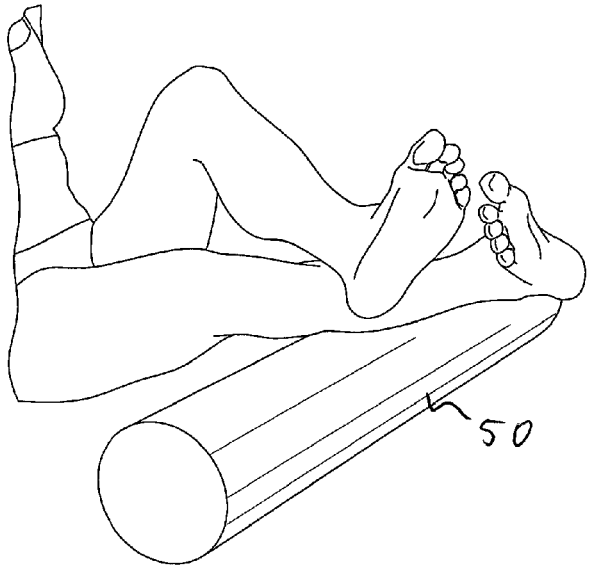
FIG. 12 is a perspective view of a demonstration of leg techniques, in accordance with the present invention.

Lower Leg Rolling:

This is a simple way to explore the tissue on the back of the lower leg. Gastrocnemius, Soleus, and Surrounding muscles need some mobilizing and this is a great way to improve ankle flexibility. A person can change one's leg angle to work both the lateral sides and the Achilles tendon. See FIG. 12.

Kneeling Prayer Position

This position may be difficult to get into if the dorsiflexion of the foot is limited. See FIG. 13. As seen in the picture, place the roller on the back of the calves and sit back. A person can also hug a ball 55 to lengthen the front of the thighs along with the anterior part of the lower leg. Hold this position for a few breaths before moving on. A person can also place the top of one's feet on the top of the roller and sit back on one's heels to lengthen the anterior muscles of the lower leg. This length technique stimulates the deep core line, and the superficial front and back lines.

The Superficial Front Line

Again begin at the pelvis and work one's way down the leg. If the leg can be reached, lengthen the thigh before rolling. See FIG. 14-A. If a person can't reach the leg, a person can try it after rolling to see if a person have made an improvement with the length. But it is a good indication that one's superficial front line is shortened if a person cannot reach the leg in this position. Make sure not to hyperextend the lower back to reach the leg.

Next, roll just one leg at a time. Move down the leg. If a person hit a barrier on the way down, externally rotate the leg so the toes turn outward. The mobilization is done up the thigh, now as the front line is moved down. Once a person gets just above the knee, apply pressure to the top of the roller, keep the core in contact and bend and straighten the knee three times to shear the tissue. Then begin to roll up the leg. If a person meets a barrier, stop just before it and bend and straighten the knee again. A person can roll back to the knee and start over or just move into the barrier and bend the knee three times again. Roll all the way up to the hip. Repeat on the other side. A person can always go back to the same leg again after a person roll the other side. But remember, with rolling, less is more.

Now lengthen the abdomen by anterior arching over the ball. See FIG. 14-B. Keep the sacrum on the ball through the movement. Do not hyperextend the back. If that is done, it will be felt in the low back. Navel stays to the spine. The person is lengthening the superficial abdomen along with some of the fibers of the deep front line.

Figure 15:
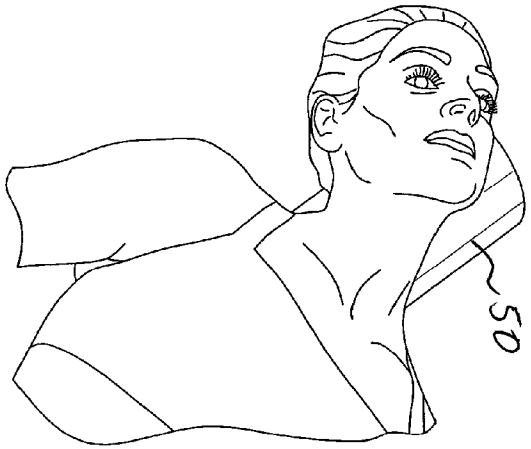
FIG. 15 is a top view of a demonstration of neck techniques, in accordance with the present invention.

Move onto neck length. Remember, do not hyperextend the neck. Gently take the head off of one side of the roller and reach the hands to the bottom of the roller to lengthen the side of the neck. A person can turn one's head slightly to vary where a person feel the length but move slowly and do not hyperextend the neck as a person turn. If a person has any neck issues, place a towel behind the neck on the roller to increase the width of the roller for better support. See FIG. 15.

Figure 16:
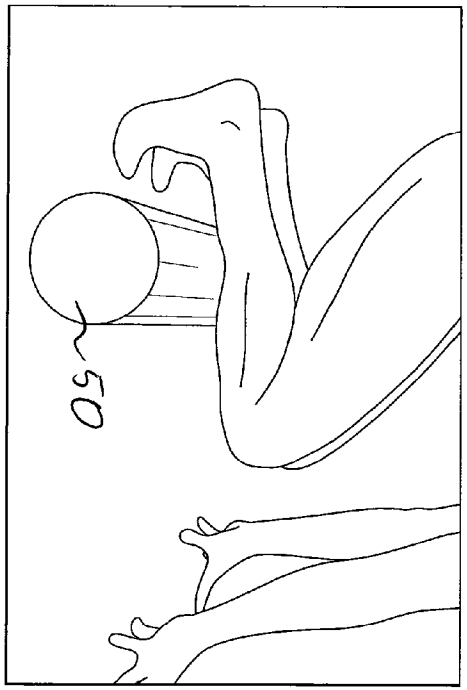
FIG. 16 is a side view of a demonstration of leg techniques, in accordance with the present invention.

Finish with tibia rolling. Small rolling can again be applied as the line is small. Roll one leg at a time or both. A person can even cross one leg over the other to apply more pressure. See FIG. 16.

The Deep Front Line

As with the superficial front line, the deep front line is rolled up the thigh, not down. Begin at the knee and find the connective tissue just above the knee. Press one's leg into the roller until a person finds the specific area of sensitivity. Then roll one's upper body forward to apply more pressure to the leg and roll up to the top of the inner thigh. A person can take up to 3 passes on one side before moving to the other leg. See FIG. 17.

The deep front line is a 3-dimensional space and blends with many other lines and is one that can be done with another line as many rolling techniques overlap with the deep front line. Try lengthening the lateral line as shown in FIGS. 17-B and 17-C. The side bending can also be done over a ball as shown in the lateral line lengthening techniques.

If a person does side bend over the roller to improve the connection with the DFL, make sure the roller is on the pelvis and not on the base of the ribs. Navel stays to the spine as a person lengthens this line.

One way, e.g., perhaps the easiest way, to work with the next length technique is next to a wall. Better yet, one with mirrors on them when a person is first learning them. Begin with the left knee on the roller, right hip placed against a wall. Level one's pelvis from left to right. Next, mildly rotate one's left pelvic bone forward and one's right pelvic bone backward. Don't let the ribs stick out. Send the pubis bone (front) upwards towards one's nose, navel may draw into the spine and the lumbar spines mildly lengthen and move apart on the backside.

Figure 18:
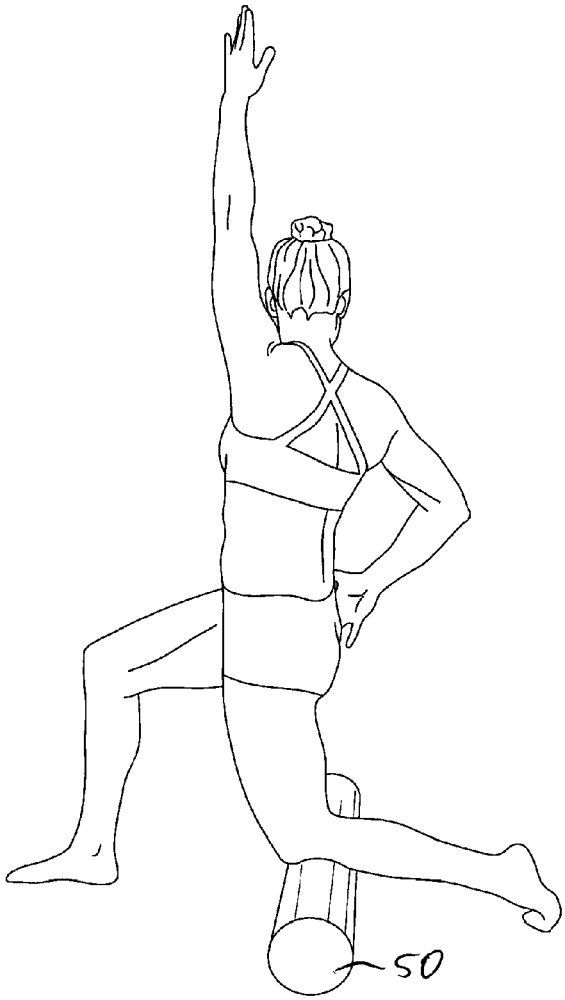
FIG. 18 is a side view of a demonstration of lengthening techniques, in accordance with the present invention.

Keep this position in the pelvis and begin to rotate one's ribs to the right. Make sure one works to differentiate the pelvic rotation from the rib rotation. Now reach one's left arm upward and slightly side bend right. See FIG. 18. The length of this line begins in the deep belly where psoas lies and blends, adapts and extends all the way from the patellar tendon on the left leg on which a person is kneeling on all the way to the finger tips. See if a person can connect to the entire fascial line from fingertip to knee base. Breathe into the body, changing where the breath goes with intention to change. Be conscious of one's body's ability to adapt to the position. A person may find that after a few breaths, a person could move even more deeply into the length. But be aware of not overdoing the motion on one's first try. Go back and do it again after a person tries the right side.

The Lateral Line

Figure 19:
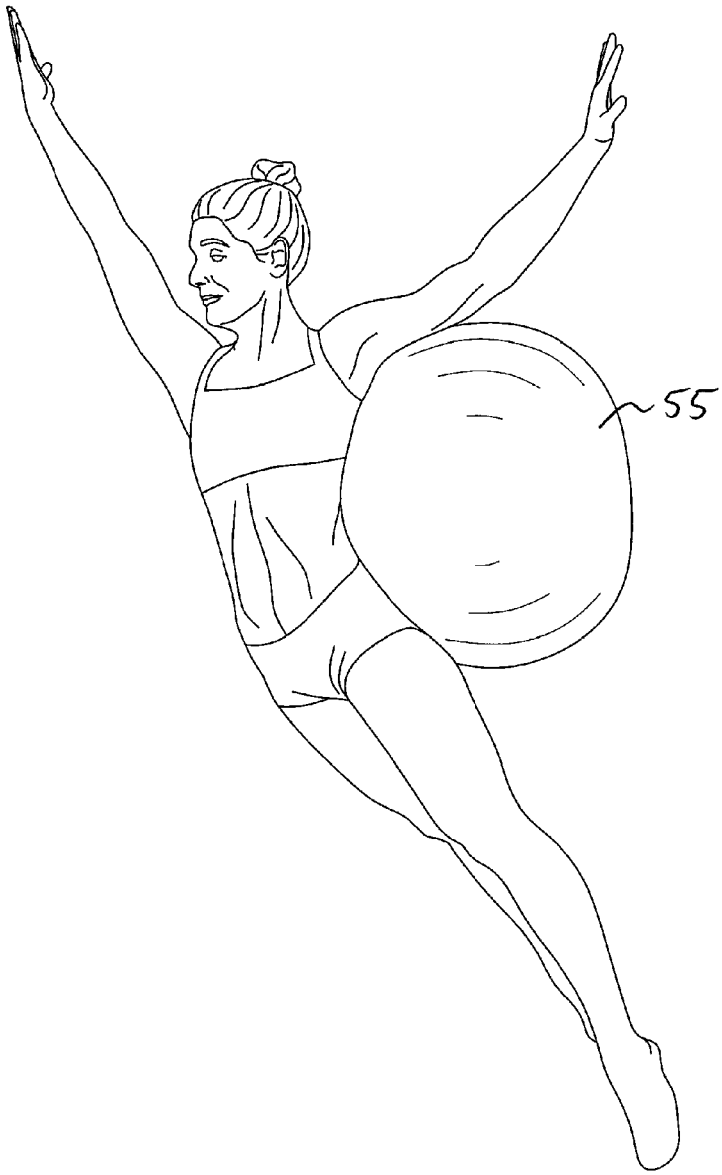
FIG. 19 is a side view of a demonstration of lengthening techniques, in accordance with the present invention.

Begin at the pelvis and side bend over a ball. Three points should be touching the ground, top leg is behind a person, bottom hand should be touching the ground Navel stays to the spine as a person begin to reach over the ball, lengthening one side of the spine and waistline at a time. Try this on both sides. See FIG. 19.

Next, try rolling the lateral hip region. This requires smaller movements again both forward and backward or from left to right to shear the tissue. See FIGS. 20-A and 20-B. If a sensitive area is found, perform the techniques of the present invention, e.g., MELT, wait and then roll either in a circular motion or from left to right again. A person can repeat this on both sides or do one side and continue on to the lateral leg.

Begin at the pelvis. If a person rolls up to the top of the pelvis and rolls backward slightly, a person will mobilize the tissue at gluteus maximus. See FIG. 20-C. Then, begin to roll past the pelvis, down the leg until a person passes the "bump" on the side of the thigh. This is the greater trochanter or outside of the upper thigh bone. See FIG. 20-D. Just below that, a person will roll and meet a barrier. Shear the tissue from left to right, return to the greater trochanter and try again this time moving into the barrier. Shear again and roll towards the knee. If the intensity is too extreme to roll the entire leg laterally, roll towards the back of the leg as a person reaches one's pain threshold near the knee to reduce the sensation. Be mindful of the pressure a person puts on one's arms. Keep one's pressure directly on top of the roller. A person can roll the calf again as a person did on the superficial back line of the body.

Kneeling Prayer Position

Figure 13:
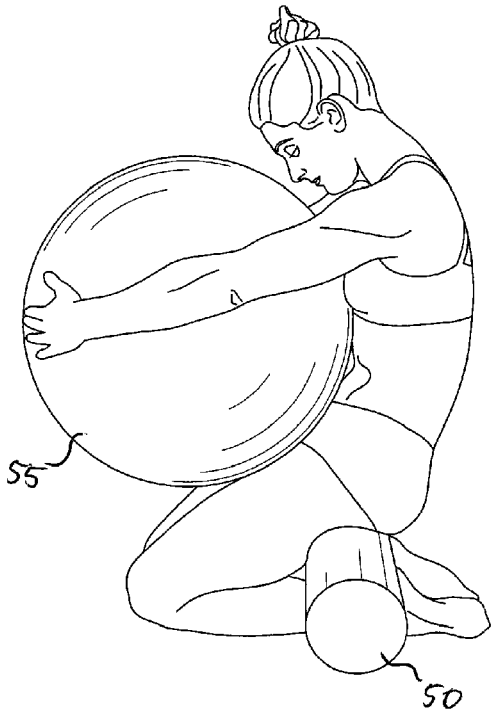
FIG. 13 is a side view of a demonstration of back techniques, in accordance with the present invention.

This position may be difficult to get into if the dorsiflexion of the foot is limited. As seen in FIG. 13, place the roller on the back of the calves and sit back. A person can also hug a ball to lengthen the front of the thighs along with the anterior part of the lower leg. Hold this position for a few breaths before moving on. A person can also place the top of one's feet on the top of the roller and sit back on one's heels to lengthen the anterior muscles of the lower leg. This reflects the deep core line, back, front and lateral lines.

The Spiral Line

As with the deep front line, this line blends with the other lines as a person lengthens and rolls. Begin at the pelvis over the ball and focus on keeping the pelvis stable as a person rotates the ribs around the axis at the top of the ball. See FIGS. 21-A through 21-B.

Begin at the pelvis. If a person rolls up to the top of the pelvis and roll backwards slightly, the person will mobilize the tissue at gluteus maximus. Then, begin to roll past the pelvis, down the leg until a person passes the "bump" on the side of the thigh. See FIG. 22-A. This is the greater trochanter or outside of the upper thigh bone. Just below that, a person will roll and meet a barrier. Shear the tissue from left to right, return to the greater trochanter and try again this time moving into the barrier. Shear again and roll towards the knee. If the intensity is too extreme to roll the entire leg laterally, roll towards the back of the leg as a person reaches one's pain threshold near the knee to reduce the sensation. Be mindful of the pressure a person puts on one's arms. Keep one's pressure directly on top of the roller.

Begin at the knee and find the connective tissue just above the knee. See FIG. 22-B. Press one's leg into the roller until a person finds the specific area where a person finds sensitivity. Then roll one's upper body forward to apply more pressure to the leg and roll up to the top of the inner thigh. A person can take up to 3 passes on one side before moving to the other leg.

The spiral line also connects the hamstring line (not shown) and a person can repeat this rolling technique as well to finish the lower leg. Remember to shear the tissue from left to right once a person passes the pelvis and is sitting on the upper leg. Apply pressure to the leg on the top of the roller.

Finish with tibia rolling. Small rolling can again be applied as the line is small. Roll one leg at a time or both. A person can even cross one leg over the other to apply more pressure.

Strength Integration Series

The present invention, in accordance with various embodiments thereof, also provides a strength integration series. The old style of aerobics and lifting is not enough anymore. Muscular strength is not the same as having structural strength. Tight, strong superficial muscles may appear toned, but coordinated movement can be degraded if the deep, intrinsic musculature is unable to maintain stability of the pelvis and lumbar spine. The present invention may provide new innovative ways to connect to the deep "inner-unit" of the core and integrate its timing and coordination with the "outer-unit" of the core. This technique, when done properly, increases circulation, prevents injury and improves the balance and stability. This program defines strength as a state in which movement potential, tone and optimal joint range are achieved with minimal effort rather than on muscular strength. A goal is to achieve pelvic and thoracic stability to improve postural alignment. Balancing tension relationships and maintaining optimal rhythms are two techniques that may be learned with Strength Integration.

#1 Pelvic Stability

This is a functional strength exercise for the hip stabilizers. If a hip is weak, the knee and low back are compromised in everything from walking to any form of exercise. Stand next to the foam roller against a wall. If one has a small platform 60 such as a yoga block or small bench it aids in the form of the exercise. The roller 50 should be placed at the hip joint, not the waist line.

The pelvis level may be kept as shown in the picture. If a hip is weak, the tendency is to sidebend at the waist to the exercising side. Once this position occurs, one is out of the position of strength. One may keep upright for the ENTIRE exercise. To perform this strength exercise, one may "root" the exercising leg into the ground. Push through the outside leg and sense the energy beginning from the foot and extending up to the hip.

Then, push the hip into the foam roller. Make sure the hip stays level to the ground.

If the hip drops on the non-exercising leg when you lift the leg off of the ground, one may reposition yourself until one can level the hip. If anything, the hip against the ball may be elevated so one can swing the leg to strengthen the stable hip position.

#2 Knee Lifting and Leg Swinging

Figure 23:
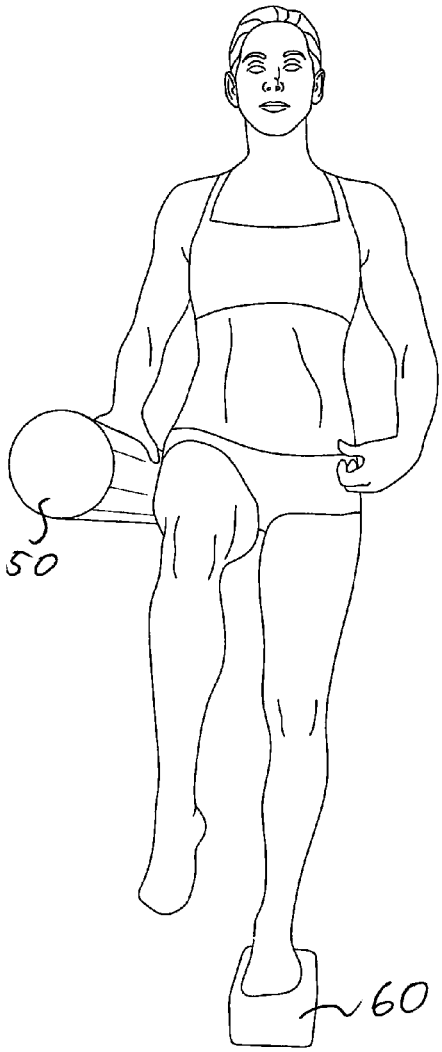
FIG. 23 is a front view of a demonstration of pelvic and leg techniques, in accordance with the present invention.

Keeping a stable pelvis, the non-exercising leg is lifted and the contraction in the standing leg is sought to be found. See FIG. 23. One should feel it on the side of the hip, not the calf, knee or ankle. If one feels it in any of those places, here are a few tips:

1. Check pelvic position. Stick the buttocks backwards a bit, anterior tilt. This should create a slight creasing of the hip joints.
2. Send the sits bones wide.
3. Imagine the energy from the foot moving externally. Find the arch.
4. Re-check alignment. Try using a mirror.

Now try swinging the leg forward and back slowly and see if the pelvic position can be maintained.

#3 Connecting Rotational Lines

When we walk, the body moves in spirals and rotational patterns. Though subtle, the precision of the rotational patterns is vital to joint integrity and body mobility. If the pelvis is fixed or the spine rigid, a body moves with a stiff looking upper body or a misplaced pelvic bowl position. This exercise focuses on the connection of the abdominal muscles, specifically the oblique musculature and how it connects to the opposing pelvic region. Keep the pelvis level and stable as you attempt to rotate the trunk from the ribs and spine. Slow movements, approximately 10 repetitions. If one finds it is more difficult to do any of these exercises on one side as opposed to the other, work an extra set or two to the weaker side to rebalance the pelvic stabilizers.

This entire series can also be used as a balance and stability exercise using only the yoga block or platform. Watch the form and remember to check the standing leg. It should not hyperextend at the knee. See FIGS. 24-A through 24-C. Also, be aware of the movement and where it comes from. Do not side bend to the opposite side to compensate for a weak hip line.

#4-7 Hip Extensor and Stability Integrity

Doing a lunge is a standard, fairly basic exercise used to strengthen legs. However, the manner in which the movement is executed can affect what muscles fire, and the sequential pattern of muscle contraction can change with each attempt of the movement. By utilizing the foam roller, the focus can be on the initial movement, creating a better intention of contraction for the gluteus maximus and other hip stabilizers to fire with greater focus and force. The next four exercises can be done entirely on one side before switching to the other leg or they can be done one at a time, alternating legs after each set is completed.

#4 The Hover and Lift

Figure 25:
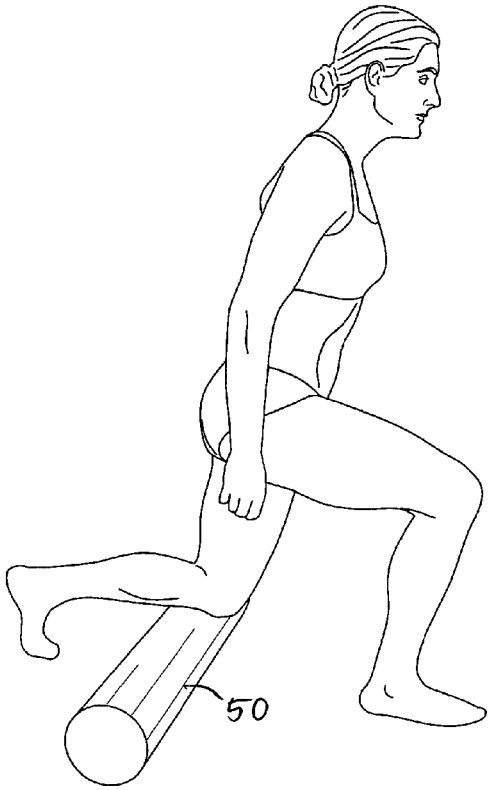
FIG. 25 is a side view of a demonstration of pelvic and leg techniques, in accordance with the present invention.

Set up in a position so the left shin is on the roller and the right leg is at a 90-degree bend at the knee and hip. Try to level the pelvis by sending the right hip back and down slightly. Now, without leaving the roller, simply focus the rooting into the right foot by leaning slightly forward to activate the gluteus maximus (butt muscles). Try this 8-10 times before attempting step 2. See FIG. 25.

#5 The Hover

Once one can contact the back line of the body, maintain the right foot press and hover the left knee over the roller. You should not feel the left leg engage. If you do, send more intention to the forward leg. Lift and lower 8-10 times before moving to the stationary lunge.

#6 Stationary Lunge

Maintain the compression and pressure to the right leg throughout the range of motion. Fully lift up onto the right leg and lower 8-10 times. Stay controlled, level pelvis, navel to spine and distal collarbones wide throughout range of motion. See FIGS. 26-A and 26-B.

#7 Forward Lifting Lunge

This is the most challenging of the exercises as one, in one motion, steps into the right leg, lifts and balances on the leg, pelvis level. Hold for a beat and lower back down to the roller reaching the left leg backwards, toe touching the floor and lower down. 8-10 Reps. See FIGS. 27-A and 27-B.

Once one has completed the series, repeat it on the left leg. Notice the balance, pelvic position and how well you maintain the focus on the forward leg as you do all of the exercises.

#8 Side Lunging Lateral Stability

Figure 28:
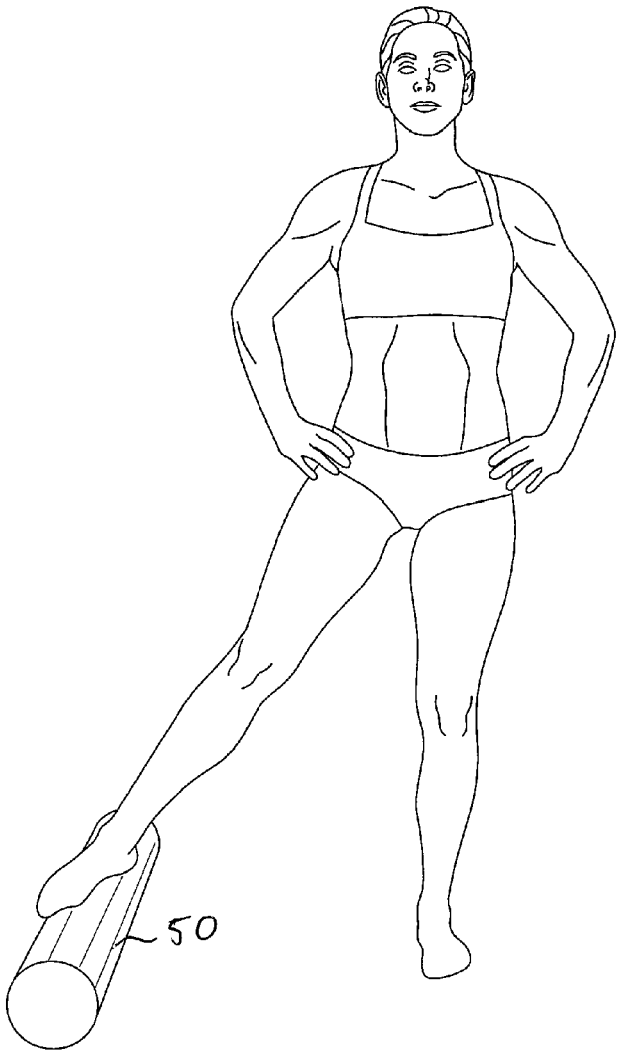
FIG. 28 is a front view of a demonstration of pelvic and leg techniques, in accordance with the present invention.

Begin with the ball of the foot on the roller. As you extend the leg laterally, the roller will move outward with the leg until the arch is on the roller. Hold the position and slowly return. See FIG. 28. The goal is to maintain ideal alignment of both the foot and ankle so watch the knee line as you lower laterally. The knee should not bowed inward.

#9 Basic Bridging

Figure 29:
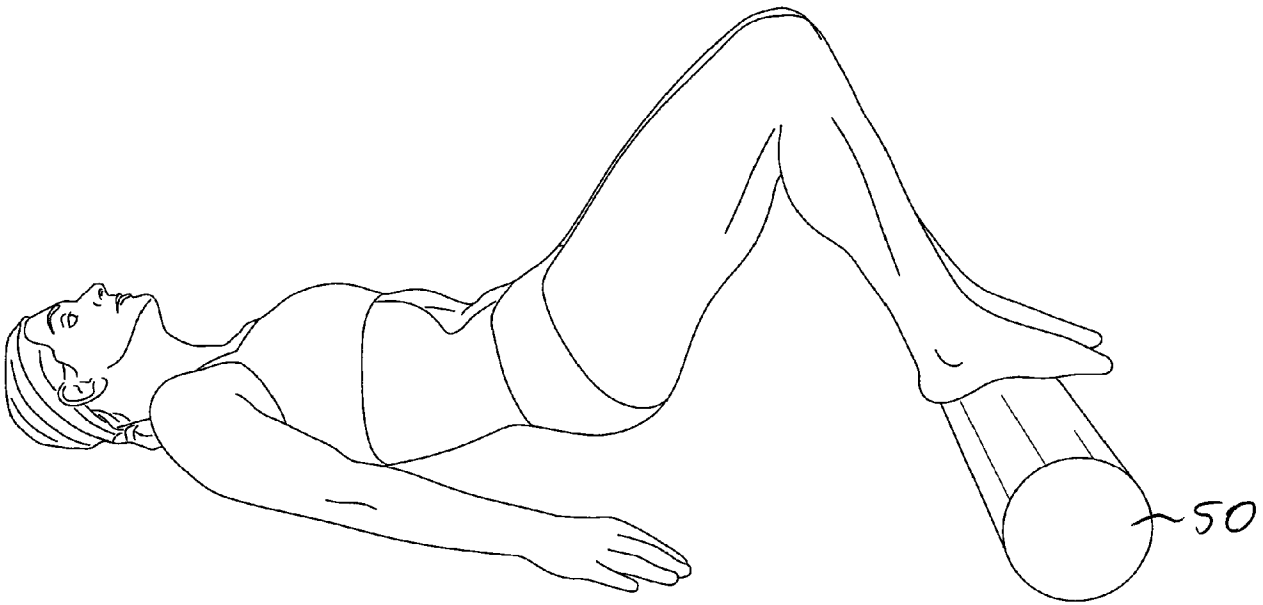
FIG. 29 is a side view of a demonstration of pelvic techniques, in accordance with the present invention.

Begin by placing the feet on the roller, laying supine. If one has a tendency to curve the neck excessively, place a rolled up towel behind the head. See FIG. 29. Next, gently posterior tilt the pelvis by 10-degrees, creating some elongation to the lumbar spine and length in the front of the hip joints.

Now elevate the pelvis without losing the posterior tilt. The front of the pelvis should lengthen, knees move towards the toes, navel to spine. Hold for a breath and slowly lower. Ten reps. To challenge the movement further. While lifted, pull the roller towards the pelvis until the heels are off the roller and then return to the beginning position. Ten reps.

#10 Hip Extension

Pelvic Placement is important when it comes to hip extension. If the pelvis is not set posteriorly, the lumbar spine may extend and curve towards the floor and most of the movement will be lost in the spine. Notice the incorrect placement above. One can see the excessive curve of both the lumbar and cervical spine. So when you set up, the pelvic position is the focus. The roller should be placed between the anterior iliac crests (two bony prominences in the front of the pelvis) and the pubis bone (more inferior to the iliac crests). The idea is to maintain pubis contact to the roller. A light pressing into the roller at pubis should help stabilize the pelvic position. Navel stays to the spine. Lift the right leg off of the floor. The pelvis should maintain a level position. Notice what is felt. The hamstrings may become very active in this first attempt to extend the leg at the hip. Maintain the position but try to relax the back of the leg by intentionally softening the muscles of the hamstring group. One has the ability to do that. Now see if one can lift the leg slightly higher, contracting the gluteus more forcefully. Hold the contraction for a breath and then lower the leg back to the floor. Repeat 10 times before repeating the technique on the other leg.

#11 Bent Knee Extensions

Figure 30:
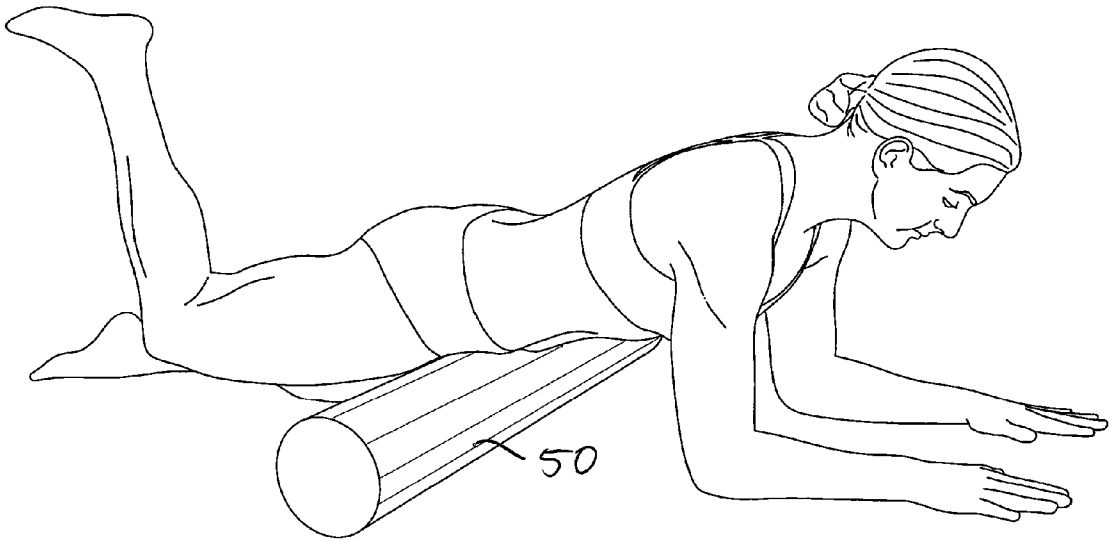
FIG. 30 is a perspective view of a demonstration of back techniques, in accordance with the present invention.

This exercise can also be performed with a bent knee. Same rules apply. Contact the pubis bone to the pelvic side of the roller, lightly pressing it in to the roller to stabilize the position. Lift the leg off of the floor being aware if one is arching the back or if you lose the abdominal integrity. See FIG. 30. Maintain a strong position and repeat 10 slow, controlled movements to strengthen the potential to extend at the hip joint.

#12 Lateral Thigh Abduction

Figure 31:
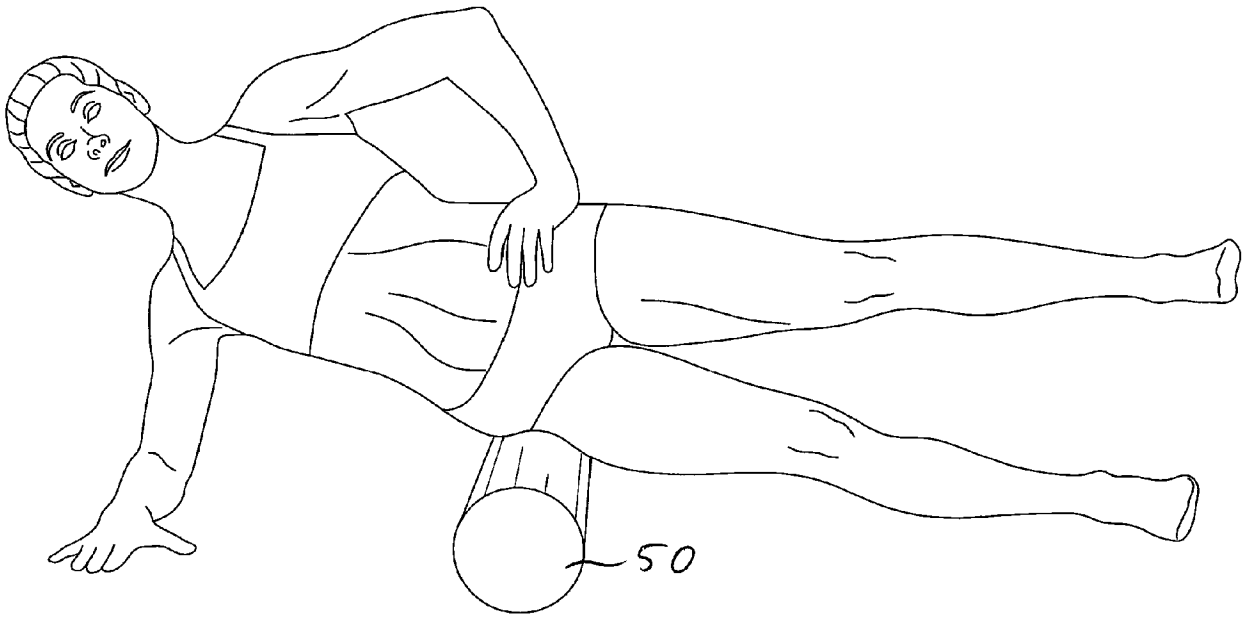
FIG. 31 is a front view of a demonstration of pelvic and leg techniques, in accordance with the present invention.

Maintain internal rotation of the upper thigh during the entire movement to decrease the deep external rotator involvement. Make sure one is not simply internally rotating the ankle instead of the hip joint. Ribs stay lifted upward towards the ceiling to reduce back compensation and a relative sinking of the spine during the exercise. Slowly lift the upper leg and hold the position of abduction for a breath or two. Internally rotate the thigh slightly and lower back to the beginning position. See FIG. 31. Try 8-10 reps before moving to the other leg. Be aware of the shoulder position. Don't sink into the shoulder blades during the lifting phase of the exercise.

#13-14 Inner Thigh Contact

Figure 32:
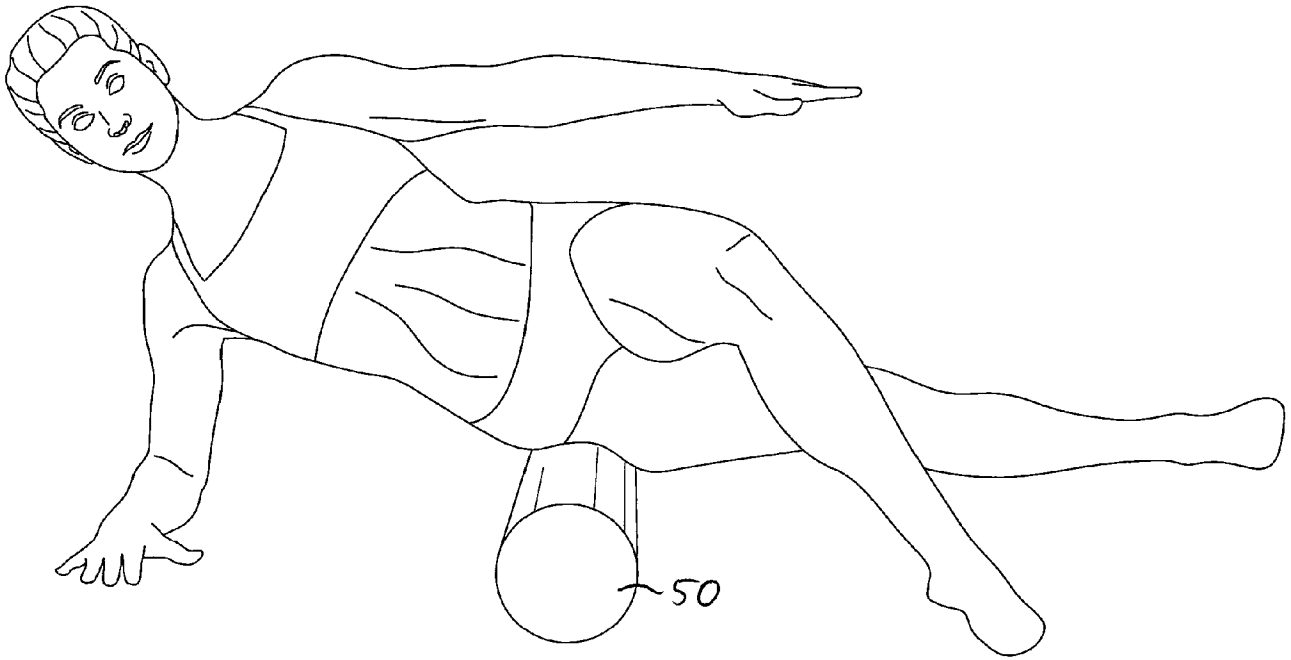
FIG. 32 is a front view of a demonstration of pelvic and leg techniques, in accordance with the present invention.

Maintain upper body stability by lifting ribs up towards the ceiling to reduce lumbar assistance in the leg raise. The placement of the person's hip upon the roller will determine the range and movement potential in this exercise. The roller is placed just above the greater trochanter or outer hipbone. It should be a familiar placement as one has used this position in other exercises of the series. Lift and hold the lower leg. One can elevate the upper arm for a greater stability challenge. Lift only with the inner thigh muscles and be sure not to side bend and use the obliques or lower back muscles to lift the leg. See FIG. 32.

#15 Advanced Bridging Technique

Figure 33:
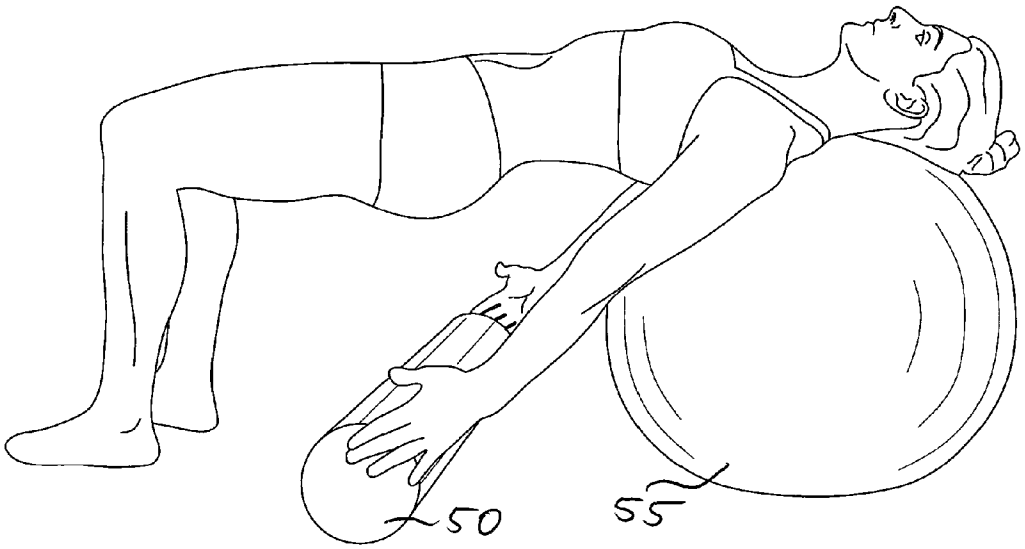
FIG. 33 is a side view of a demonstration of pelvic and back techniques, in accordance with the present invention.

Maintain a neutral pelvis and spine. Placing the roller under the feet or lifting one leg at a time in this position can further challenge the position. Maintain a posterior tilt of the pelvis, pubis bone lifted towards the ceiling. Lengthening the front of the thighs as you use the hip extensors to maintain the position. See FIG. 33.

Core Stabilization and Coordinated Patterns of Strength

Now that one has worked with lessons of pelvic tilting, navel to spine and differientiation of thorax and pelvis, it is time to strengthen the abdominal wall. We will not do a single crunch. Most exercises you see regarding "core abdominal" strength focus on the superficial musculature. These exercises bring awareness to the deeper muscle fibers of spinal and organ support. Each exercise is more challenging than the next. Before doing any of the exercises with the hands on the floor, remember one can always do the hand rolling techniques to open the wrists so optimal positions can be achieved.

#16 Balance Coordination

Figure 34:
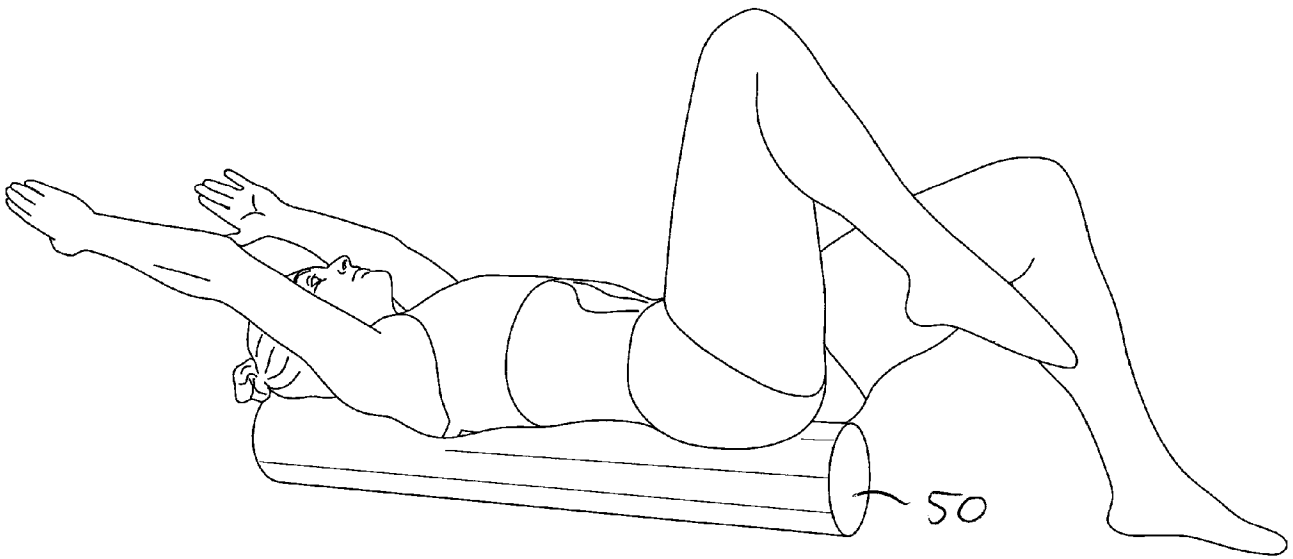
FIG. 34 is a perspective view of a demonstration of abdominal techniques, in accordance with the present invention.

This exercise strengthens the proprioceptive responses from the deep spinal stabilizers. It looks easy but is difficult to maintain a strong centering with limited base support. Begin by simply lifting one leg off of the ground, pulling the heel into the buttocks as you lift the leg. Keep the fingertips on the ground. See how you do on both sides. Next, try it without holding the floor. Once one can balance on one leg with no hand holding, bring the arms overhead and back two times while holding the position level and core connected. See FIG. 34.

#17-19 Core Contacted Roll-Up

Figure 35:
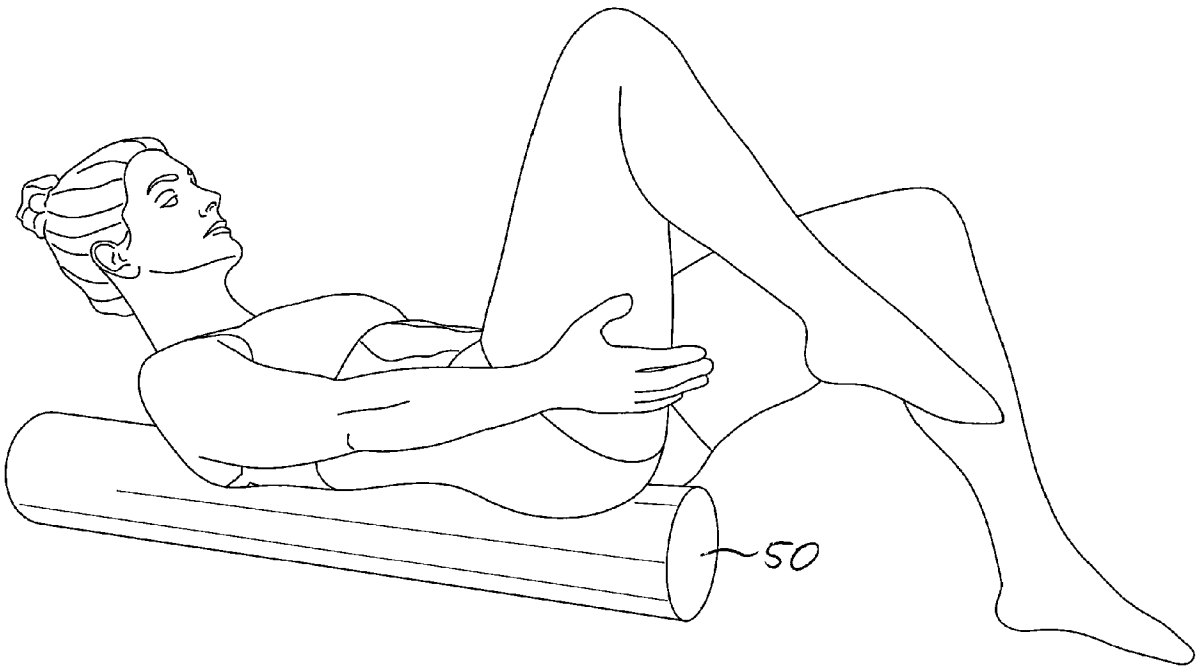
FIG. 35 is a perspective view of a demonstration of abdominal techniques, in accordance with the present invention.

Maintain the same position as above, only now, curl up from the sternum to lower rib being aware of navel to spine and allowing the neck to stay relaxed. One can try this position with the hands behind the head at first. To increase the challenge, reach arms overhead as one did in the last exercise while holding the trunk flexion. See FIG. 35.

#20 Thoracic Curl

Figure 36:
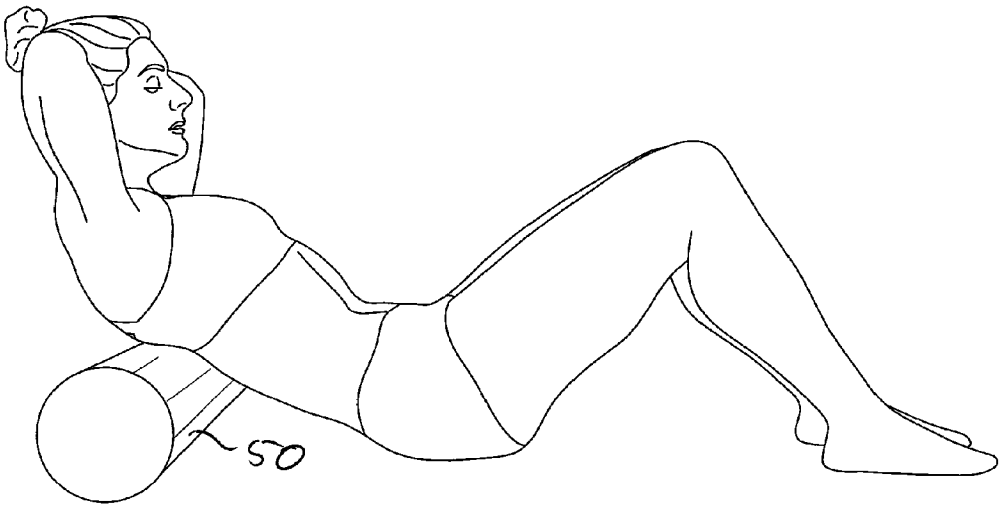
FIG. 36 is a perspective view of a demonstration of abdominal techniques, in accordance with the present invention.

Focus on maintaining contact directly on the top of the roller as you curl the trunk upward. Roller is placed at the bra-line or 8th thoracic vertebrae. Maintain a posteriorly tilted pelvis throughout range of motion. See FIG. 36. This exercise helps one to learn how to contact rib movement during abdominal contraction. Neck stays long, heartcenter stays heavy.

#21 Pelvic Tilted Toe Tap and Reach

Place the pelvis on the top of the roller so the sacrum is heavy on the roller. The roller should not feel as if it will roll away from you nor should it feel as if it is in the lumbar curve. With the pelvis lifted, it should be easy to sense the length in the low back. The goal is to maintain the elongation in the lumbar as you lower one leg at a time towards the floor. This is a great exercise to find out if one is tight in the hip flexors. If the flexors are tight, you will find the low back curving as you lower the leg towards the floor. To challenge the motion, extend the leg you will lower. Now the lever arm is longer and heavier to the stabilizers. Move slowly and remember to continuously check to see if one can posteriorly tilt the pelvis more to maintain length in the low back. See FIGS. 37-A through 37-C. Reset the position over and over. One may tune into feeling the deep abdominal wall stabilizing the low back as you move the leg. The leg motion is not the focus. Try 10 repetitions alternating sides for 2 sets.

#22 Plank Pose Variations

Figure 38:
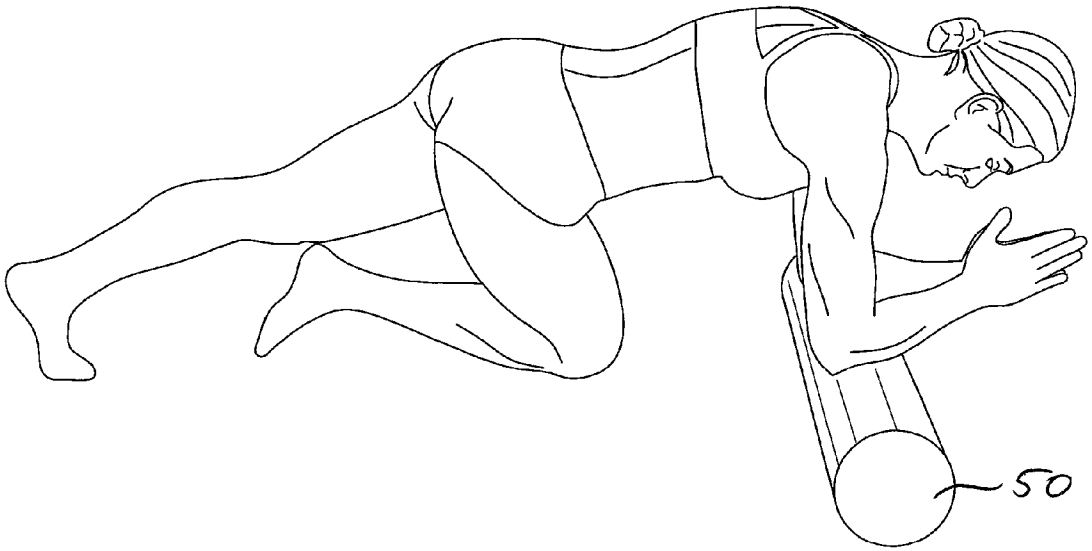
FIG. 38 is a side view of a demonstration of abdominal and back techniques, in accordance with the present invention.

This is the single best exercise for full core contact as it strengthens the stabilization mechanics like a girdle around the middle region of the body. Place the upper forearm on the roller just below the elbow. Clasp the hands together. Shoulder blades may stay stable, distal collarbones are wide. Navel to spine, lift the body off of the ground. See FIG. 38. Do not sink the pelvis or extend the low backbones. This position should be held for a minimum of 10 seconds, working up to 30 seconds, 2-3 times. Once one can do this, one can add variations such as shifting the pelvis from side to side without lowering the pelvic bones or extending the low backbones, or releasing one leg and drawing the knee towards the opposite shoulder (shown in picture) and alternating from side to side 10 times. Rest and try again.

#23 Abdominal Roll-In

This is a very challenging exercise. A concern in doing the next two exercises is the extended wrist action. It is suggested doing the hand rolling before doing this exercise to ensure ideal wrist extension. Also, be aware of both the shoulders and elbow positions. Navel stays to the spine, slowly draw the legs in towards the chest. Go only as far as the pelvis will allow without tucking the pelvis or elongating the spine. Neutral spine, neutral pelvis throughout the range. Return to the beginning position. See FIGS. 39-A through 39-B. Try 5-10 repetitions, 1-2 sets.

#24 Full Pike

Figure 40:
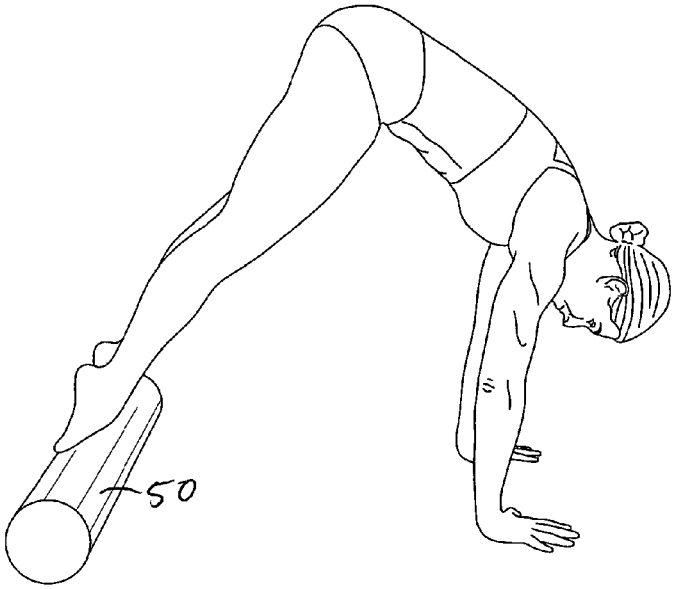
FIG. 40 is a side view of a demonstration of abdominal and back techniques, in accordance with the present invention.

One of the most challenging exercises is a full pike. Navel stays to spine. Maintain a press into the top of the roller with the tops of the feet as you roll in, lift the pelvis high. Be mindful of the elbow joints and allow the shoulder joint to maintain an angle less than overhead as seen in FIG. 40. This is not a movement that would bring you to a hand stand. Rather it is just a strong sweeping lift that contacts the deep abdominal wall throughout the entire range of motion. Try 5-8 repetitions and rest. After working either of these exercises, go through the hand rolling or wrist release exercises again.

#25 Thoracic Rotation

Sit directly on top of the roller. Create a posterior tilt of 10-degrees so the pubis bone moves upward towards the nose. Hands begin behind you to find the pelvic position then lift hands off the floor and reach in front of the body. Keep the distal collarbones wide (don't round the shoulders). Begin the movement by rotating through the ribs. Keep the pelvis level and neutral. Try to reach out to the end of the roller. This should not be easy (if it is one has moved the pelvis or shoulder girdle instead of keeping the movement exclusive to the ribs. Lean back slightly as you reach the full rotation, hold of a breath and in one full movement pass the first position and reach to the opposite side of the roller. See FIGS. 41-A through 41-B. Try 10-15 rotations and rest.

#26 Core Contact Challenge

Begin this exercise by placing the roller between the legs. Feel the inner thigh engage to hold the roller. Now grasp the side ends of the roller. As you squeeze the roller between the hands, the person should sense the deep abdominal wall contract spontaneously. The feed forward mechanism of the core is working. Maintain a stable pelvis, navel to spine and try to lower the legs towards the floor assisting with the roller to reduce the leg weight as one goes. See FIGS. 42-A and 42-C. Try this 8-10 times.

Now try to lower the legs and elevate the torso at the same time. Pull on the roller to return the legs back to the beginning position and rest. Try this 8-10 times.

Now that we have a scientific perspective on how the shoulder moves, let's add "lifestyle" into the mix. For those who work at a computer for hours on end, carry bags on the shoulders, wear fashionable shoes with little support or simply exist with our days emphasising one-sided work, these movements are helpful and can give insight on one's own dysfunction. As shown by the virtue of science and anatomical zero, the shoulder joint is made to be very mobile yet stable to endure the usage over a lifetime. In my own practice, I find people with moderate lifestyles are highly susceptible to injuries of the shoulder girdle. More often, it is their basic posture that puts them at risk for injury and allows for poor patterning. It is most often the rib placement that hinders smooth shoulder girdle glideability. A good cue to remember when working with strength of the shoulder girdle is "heavy, anchored ribs". Try avoiding the habit of lifting the front of the ribs slightly as shoulder motion is created. The front of the ribs stay heavy and anchored towards the pubis bone to give a platform for the arm and shoulder girdle to move.

The Set-Up for Creating Lateral Arm Motion

Figure 43:
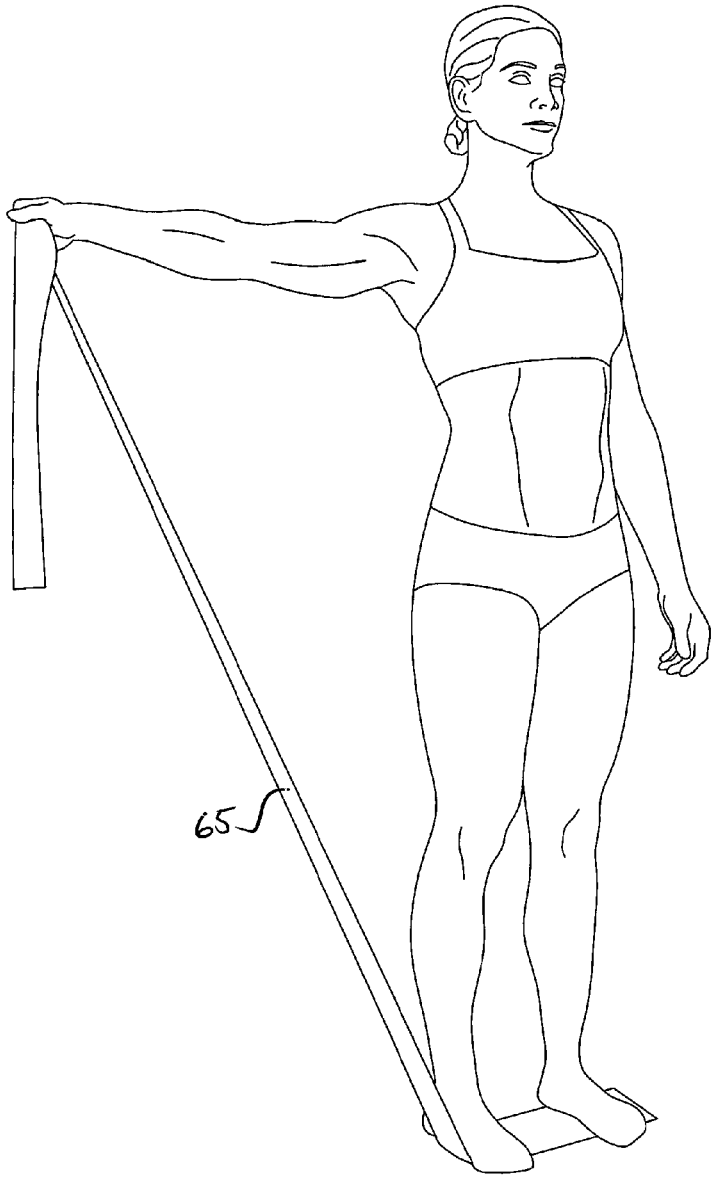
FIG. 43 is a perspective view of a demonstration of arm techniques, in accordance with the present invention.

This movement requires very little shoulder girdle motion. The arm moves and the lateral deltoid does the majority of the work. To begin, stand at one end of the resistant band 65, feet hip width apart. Hold the top end in one hand. Now side bend to the resistant band 65 to take up some slack for the to resist as you lift the arm. See FIG. 43.

#27 60-Degree Lateral Arm Raise

From anatomical zero position, allow the arm to move approximately 60-degrees outward, hold for a breath and return to the beginning position. Try this 10 times.

#28 90-Degree Lateral Arm Raise

Now try ten repetitions with the arm moving to the horizontal range of 90-degrees. There is no side-bending to the opposite side as you raise the arm and be aware of the shoulder girdle placement. It should remain heavy and only move slightly outward at the base of the girdle as the arms lifts.

#29 180-Degree Arm Reach

This range is the full range of both the arm and shoulder girdle motion combined. If the girdle did not move, we would not be able to reach the arm fully without compensatory actions found by sidebending or shrugging as we raised the arm. To do this motion, slacken the resistant band so one is holding the end of the band. Now reach the arm fully outward and upward to 180-degrees, following the same motion you made for the other shoulder exercises previously. The resistant band should "snap" when lifted as there is very little resistance on the band currently. The idea is for the musculature to respond to the end range of motion when the resistant band is at its taut position. As you use the resistant band instead of weights, it will be the "pulling" of the band back towards the floor that you will be working against. We are looking to recreate proper movement of the arm and girdle, not necessarily "bulkier or stronger" muscles in the shoulders, the strength will improve but the focus is more about joint range than building muscles. Repeat this motion 10 times.

#30-31 Neck Movement and Strength

Begin in a prone position (face down). Make a note of the shoulder position. Allow a natural position to be kept by the participant but work to keep the shoulder girdle out of excessive protraction. Cue "distal collarbones wide".

Now cue to send the face into water and then lift the face out of the water without tipping the head. It is as if someone was pulling the person out by a pony-tail or by the backs of the ears. The face stays level throughout the range. Hold the lifted position for at least 15 seconds or three full breaths then return to the beginning position. Watch for hyperextension of the cervical vertebrae around C3-C6.

Lateral Raises

Figure 47:
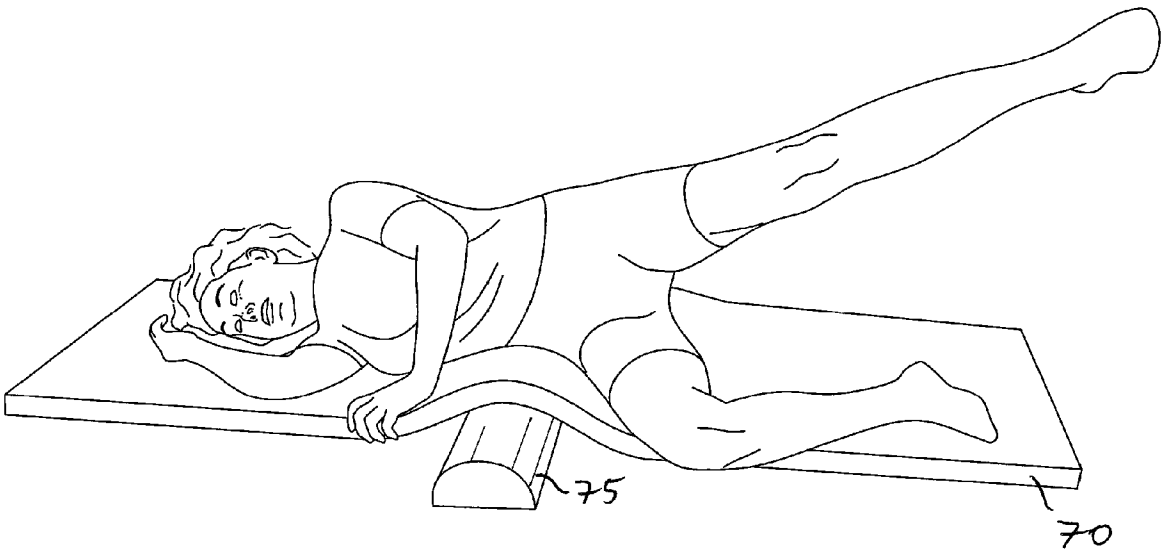
FIG. 47 is a side view of a demonstration of pelvic techniques, in accordance with the present invention.

If the roller is too difficult for a person to lay on, they may perform a lateral leg raise with a half roller or bolster under the hip instead. Pelvis stays rotated inward as the leg lifts and a slight internal rotation can be maintained through the range of motion. See FIG. 47. Perform 8-10 very slow leg raises on each side.

Vibrating Roller Device

As set forth above, two of the ways that a participant may practice the principles of the present invention is by using a roller and by vibration. The present invention, according to various embodiments thereof, may include devices, and methods of using such devices, that combine the benefits of a roller and a vibration tool into a single apparatus.

Figure 48:
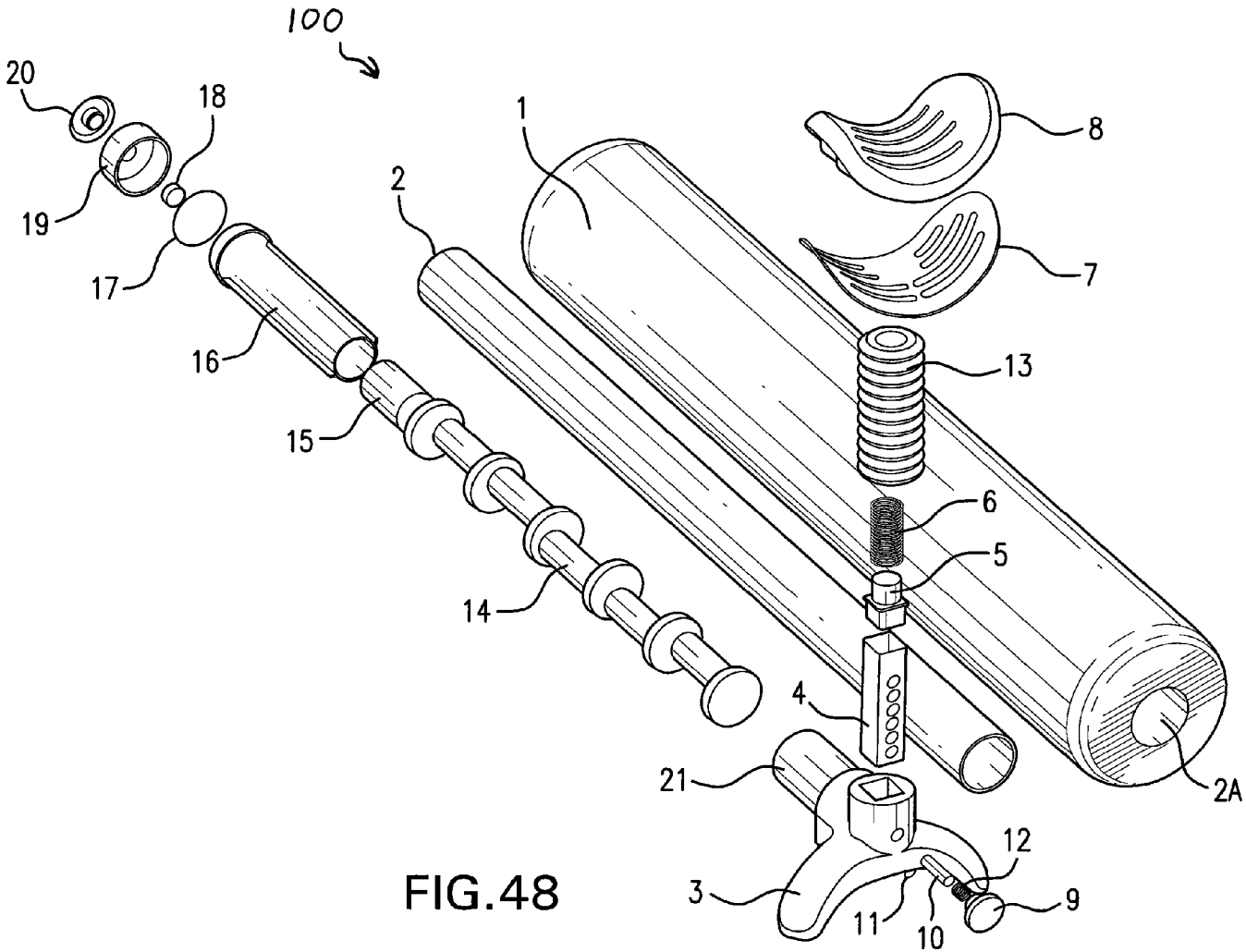
FIG. 48 is a perspective view of the vibrating roller device and head cradle, in accordance with the present invention.

FIG. 48 is a perspective view that illustrates an example embodiment that combines a roller and a vibration tool into a single apparatus. Specifically, FIG. 48 illustrates the parts of a vibrating roller device 100. The table below lists the various components of the embodiment as shown in FIG. 48.

| ITEM # | QTY | PART # | DESCRIPTION | MATERIAL |
|---|---|---|---|---|
| 1 | 1 | — | BOLSTER | FOAM |
| 2 | 1 | — | INNER TUBE | PLASTIC EXTRUSION |
| 3 | 1 | — | HEAD REST BASE | PLASTIC |
| 4 | 1 | — | ADJUSTMENT TUBE | STEEL |
| 5 | 1 | — | ADJUSTMENT TUBE CAP | PLASTIC |
| 6 | 1 | — | HEAD REST SPRING | STAINLESS SPRING STEEL |
| 7 | 1 | — | HEAD REST | PLASTIC |
| 8 | 1 | — | HEAD REST POLSTER | FOAM |
| 9 | 1 | — | LOCKING KNOB | PLASTIC |
| 10 | 1 | — | LOCKING BOLT | STAINLESS STEEL |
| 11 | 1 | — | C-CUP | — |
| 12 | 1 | — | LOCK SPRING | STAINLESS SPRING STEEL |
| 13 | 1 | — | BELLOWS | RUBBER |
| 14 | 1 | — | VIBRATOR | COMPONENT |
| 15 | 1 | — | MOTOR | COMPONENT |
| 16 | 1 | — | BATTERY MOTOR HOUSING | PLASTIC |
| 17 | 1 | — | BATTERY CAP WALL | CUT PLASTIC SHEET |
| 18 | 1 | — | SWITCH POTI | COMPONENT |
| 19 | 1 | — | BATTERY CAP | PLASTIC |
| 20 | 1 | — | POWER KNOB | PLASTIC |

#32 Serratus Anterior Strength

Figure 45:
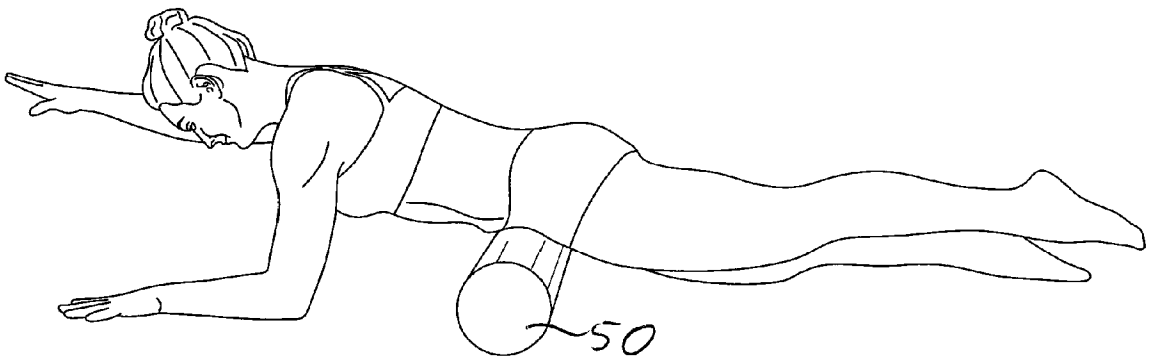
FIG. 45 is a side view of a demonstration of back techniques, in accordance with the present invention.

This is a common area of dysfunction, weakness or inhibition for many people. As with all of the movements, navel stays to the spine. Cue to bring the pubis bone towards the roller to improve lumbar length and position. Elbows are under shoulders, just slightly in front of the shoulder line. Imagine pulling the elbows towards the roller and into external rotation. Hold the position and extend one arm forward, and maintain pelvic position. Next, extend contralateral leg, hold for about 10 seconds and release. See FIG. 45. Repeat on other side. Notice if one side maintains more stability or if rotation is seen in the pelvis. The lower fibers of serratus' origin interdigitates with external oblique. Serratus anterior is the strongest protractor of the scapula and holds the scapula against the chest wall to provide a fixed origin for muscles acting on the humerus. Weakness causes "winged scapula".

Modifications for Hip Strength

Clam Rotation

Figure 46:
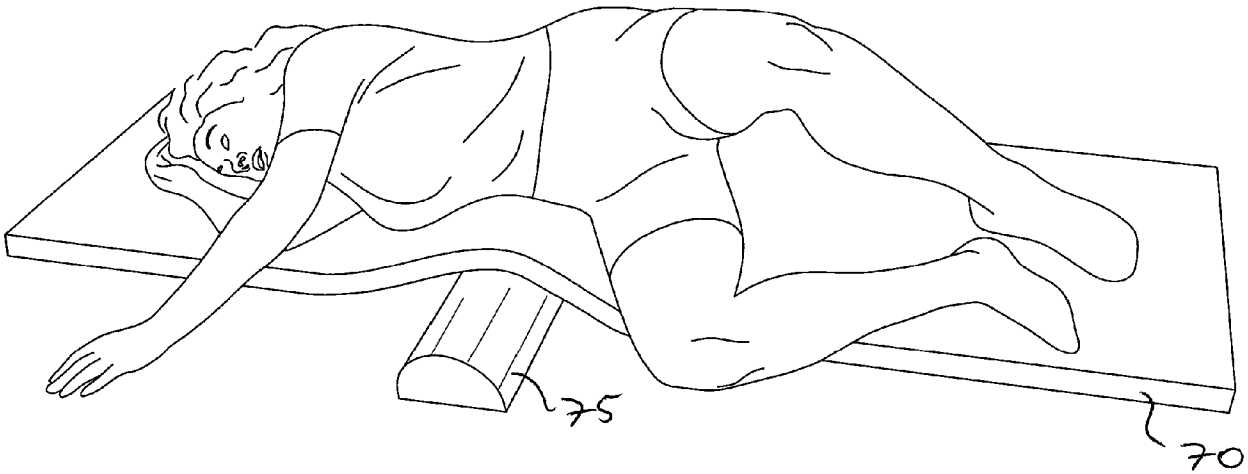
FIG. 46 is a side view of a demonstration of pelvic techniques, in accordance with the present invention.

Clamming the legs is very beneficial for people with instability of the pelvis. The top hip may stay rotated inward. The tendency is to move the pelvic bone backwards as the leg is lifted. Both heels should remain on the floor and together throughout the movement. See FIG. 46. A bolster or a half roller 75 can be placed under the pelvis for better stability and form.

The vibrating roller device includes an outer core or bolster 1. The outer core 1 forms a roller having a generally round cross-section. The outer core 1 is shown in FIG. 48 as having a longitudinal length that is greater than the cross-sectional diameter of the outer core 1. It should be understood, however, that the longitudinal length of the outer core 1 may be any conceivable length, and may be smaller than, equal to or greater than the cross-sectional diameter of the outer core 1.

The outer core 1 includes an interior region 2A. While FIG. 48 illustrates the outer core 1 having a single interior region 2A, it should be understood, however, that the outer core 1 may have any number of interior regions 2A, or that the interior region 2A may include any number of separate parts or sub-regions. FIG. 48 illustrates that the interior region 2A of the outer core 1 is an interior bore 2A that extends longitudinally through the outer core 1. This interior bore 2A is configured to house a vibration producing element 14, that is described in additional detail below. The vibration producing element may be housed in a tube 2. While the interior bore 2A is shown in FIG. 48 as extending in a longitudinal direction relative to the outer core 1, it should be understood that, in other embodiments, the interior bore 2A may extend in any direction relative to and within the outer core 1. Also, while the interior bore 2A is shown in FIG. 48 as extending along a centrally-disposed longitudinal axis of the outer core 1, it should be understood that, in other embodiments, the interior bore 2A may extend along an axis that is not the centrally-disposed longitudinal axis of the outer core 1, but rather extends, e.g., along a different longitudinal axis and/or that is spatially arranged to be radially closer to an outer surface of the outer core 1 at one circumferential location relative to a second circumferential location. Such an arrangement may be advantageous when, e.g., different amounts of vibration may be desired at different portions of a rolling movement, or when the vibration producing element 14 provides an additional degree of structural rigidity to the outer core 1 that is desired to be present at different circumferential portions of the outer core 1.

FIG. 48 illustrates that the interior bore 2A is accessible or open at a first end of the outer core 1. In this way, the vibration producing element 14 may be inserted into the interior bore 2A. The interior bore 2A of the vibrating roller device being accessible or open at the first end of the outer core 1 may also provide access to an end of the vibration producing element 14 which, as described in additional detail below, may include control elements of the vibration producing element 14. In FIG. 48, the outer core 1 and the vibration producing element 14 are configured such that the interior bore 2A extends along a portion of length of the outer core 1.

FIG. 48 illustrates an embodiment that combines a roller and a vibrational tool to form a vibrating roller device apparatus, combined with a head cradle that can be inserted into the interior bore of the apparatus. The parts of the head cradle are shown in FIG. 48 as having a region 21 which can be inserted into the vibration producing element inside the roller. The component may attach to the head support by a means of a rubber bellows 13, or in another embodiment, by a ball or swivel joint. This will allow for rotation of the neck while the head cradle is in use. In an embodiment, the head support 7 may have a concave surface to accommodate the shape of a user's head. The head support 7 may also be covered in foam 8, or another material commonly used in the art which would serve to increase comfort for the user.

FIG. 48 illustrates the connecting component 4 as fitted with an adjustable lock hinge 9. Such arrangement is advantageous in that it allows for adjustment of the height and angle of the head position in consideration of a user's neck extension issues. It should be understood however that other embodiments may use a hinge, bracket, latch, or other connection medium commonly used in the art in order to achieve adjustability of the height and angle of the head cradle. Use of the head cradle in conjunction with the vibrating roller device can be used to improve the movement and articulation of joint range in the cervical vertebrae.

In an embodiment, the vibration producing element 14 and the outer core 1 are configured such that the vibration producing element 14 is permanently installed within the outer core 1. Alternatively, in other embodiments, the vibration producing element 14 and the outer core 1 may be configured such that the vibration producing element 14 is removably installed with the bore. Such an arrangement may be advantageous when, e.g., the outer core 1 is anticipated to wear out sooner than the vibration producing element 14, thereby allowing a new outer core 1 to be placed on the vibration producing element 14 when the outer core 1 has surpassed its useful life. Such an arrangement may also be advantageous when a user wishes to use vibration producing elements 14 having different vibrations capacities within the same outer core 1. For example, a user may remove a vibration producing element 14 that provides a relatively low amount of vibration from the outer core 1 in order to instead insert in the outer core 1 a vibration producing element 14 having a relatively high amount of vibration, or vice versa, depending on the amount of vibration that is deemed to be most beneficial or appropriate for a person being treated. In the preferred embodiment of the invention, the vibration producing element will create vibrations at a frequency of 60 hertz. Studies have shown that treatments given to astronauts upon their return from space which incorporated 60 hertz vibrational therapy improved bone density of the treated individuals. However, vibration producing elements can be made to operate at higher and lower frequencies to suit the needs of an individual user, e.g., between about 0 and 160 MHz.

Figure 49:
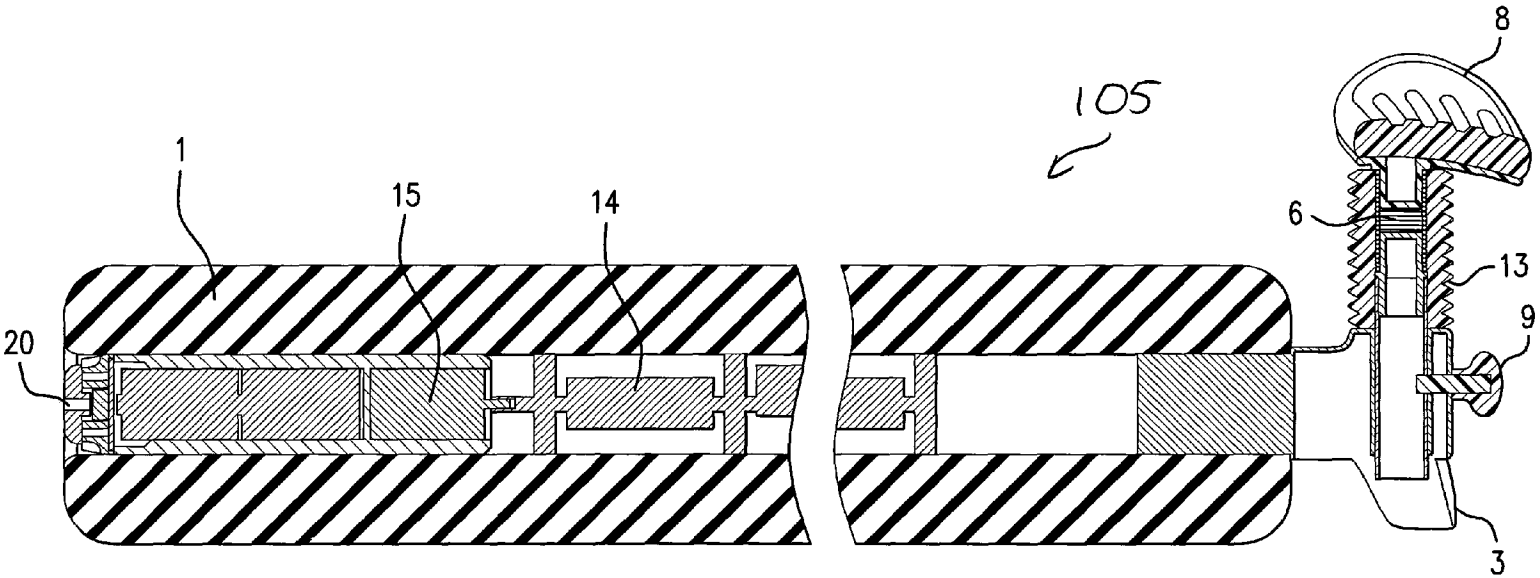
FIG. 49 is cross sectional view of the vibrating rolling device and head cradle taken along line A-A of FIG. 50, in accordance with the present invention.

FIG. 49 is a cross-sectional view that illustrates another example embodiment of a vibrating roller device and head cradle. Specifically, FIG. 49 illustrates a vibrating roller device 105 in which the generally cylindrical vibration producing element 14 has been inserted into the inner bore 2A of the roller as was shown in FIG. 48. It should be understood that, in other embodiments, the vibration producing element may attach to the roller by any other manner of mechanical connection. Also, while the vibration producing element 14 is shown in FIG. 49 as extending along a centrally-disposed longitudinal axis of the roller, it should be understood that in other embodiments, should the interior bore extend along a non-centrally disposed longitudinal axis, the vibration producing element would be inserted and positioned in a manner corresponding to the interior bore.

FIG. 49 illustrates that the roller may be the same length as the vibration producing element. In an alternate embodiment, the roller may be longer than the vibration producing element. In one embodiment, an inner portion of the vibration producing element may serve as housing for the power source of the vibrating roller device, such as rechargeable or disposable batteries. It should be understood however, that in other embodiments, the vibration producing element may impart vibrational movement to the vibrating roller device by any other vibration mechanism. An embodiment may also incorporate the option for the vibrating roller device to become heated. Such an option may be advantageous because application of heat at strategic stages of massage or physical therapy can help to relieve tight and sore muscles, and otherwise facilitate the physiological benefits described herein. In an embodiment, the vibration producing element may have a 'control cap' or 'control panel' 20 on one end of its cylindrical body which allows for switching the power source on and off, switching the heat option on and off, and may also control the speed and/or power of the vibrations created by the vibration producing element. Additionally, an embodiment may also include a strap affixed to one end of the vibration producing element 14 so that it may be easily disconnected from the roller.

Figure 50:
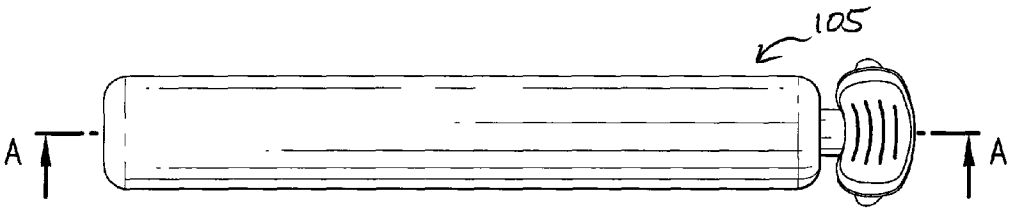
FIG. 50 is a top view of the vibrating rolling device and head cradle, in accordance with the present invention.

FIG. 50 is a top view of the vibrating roller device and head rest.

The vibratory action of the apparatus, in combination with rolling, lengthening and strength techniques, will enhance the longevity and integrity of body function and form. Use of the present invention affects and stimulates various myofascial mechanoreceptors such as the Golgi, Pacini, Ruffini, and interstitial receptors, and such stimulation is believed to confer various health benefits on the recipient. Golgi receptors are responsive to muscular contraction and strong stretching, whereas Pacini receptors are stimulated by pressure changes and vibration. Ruffini receptors respond to pressure and lateral stretching. Correct stimulation of these various mechanoreceptors may trigger the central nervous system to alter the tonus of the muscle tissue to improve posture, alignment, and joint range. Additionally, studies show that stimulation of Ruffini and interstitial mechanoreceptors cause an increase in vagal activity and positively affect myofascial fluid dynamics, tissue metabolism, blood flow, and blood pressure, as well as promotion of global muscle relaxation.

Figure 52:
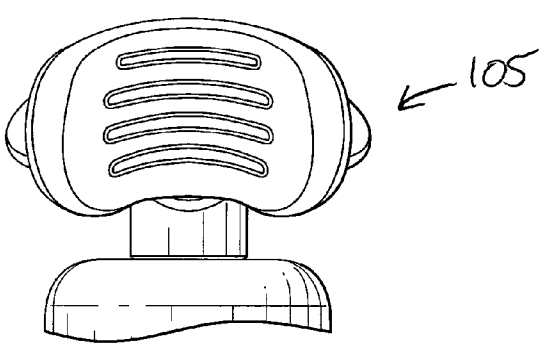
FIG. 52 is a front view of the head cradle, in accordance with the present invention.
Figure 51:
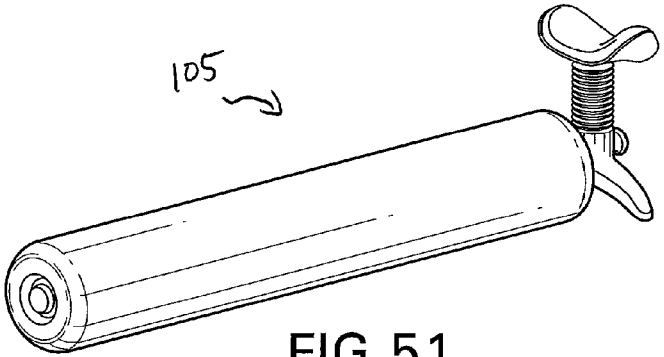
FIG. 51 is a perspective view of the vibrating rolling device and head cradle, in accordance with the present invention.

FIGS. 51 and 52 show a perspective and side view of the head cradle when it is affixed to the vibrating roller device.

Figure 53:
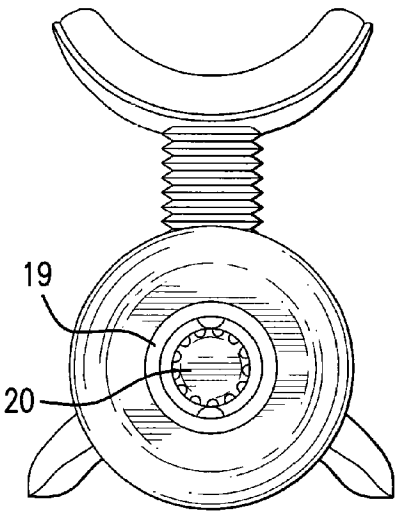
FIG. 53 is a side view of the vibrating roller device and head cradle, in accordance with the present invention.

FIG. 53 is a side view of the vibrating roller device when it is affixed to the head cradle. FIG. 53 illustrates the control cap or control panel 20 which would hold the power switch and vibration frequency adjuster.

Figure 54:
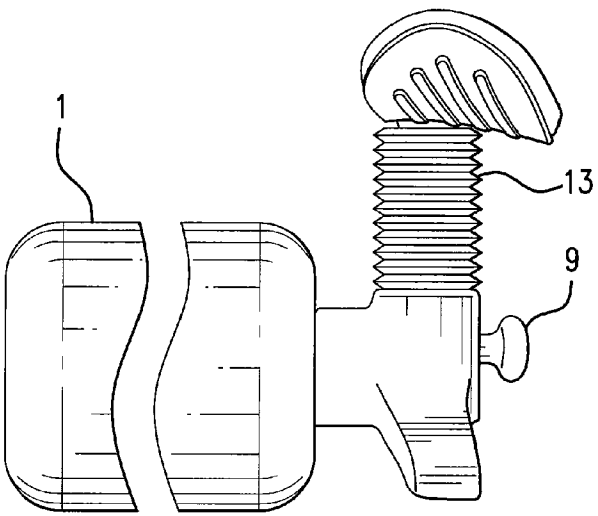
FIG. 54 is a side view of the vibrating rolling device and head cradle, in accordance with the present invention.

FIG. 54 is a front view of the vibrating roller device when it is affixed to the head cradle. FIG. 54 illustrates the bellows 13 component of the head rest. A coil spring 6 would be inserted within the bellows 13 allowing the head rest to pivot in all directions. FIG. 54 further illustrates a locking knob 9 which can be used to adjust the vertical position of the head rest. This locking knob 9 can be used to in conjunction with a locking bolt 10, c-clip 11, lock spring 12, and adjustment tube 4 to adjust the height as shown in FIG. 48.

Figure 55:
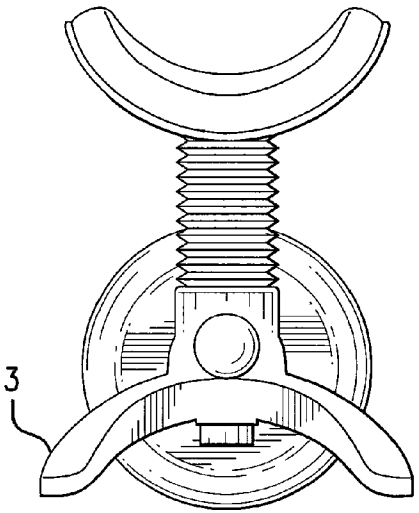
FIG. 55 is a rear view of the head cradle and vibrating rolling device; in accordance with the present invention.

FIG. 55 is a side view of the head cradle when it is affixed to the vibrating roller device. FIG. 55 illustrates the support arms 3 which provide stability and hold the head rest upright for a user.

Similar to the head cradle, although not specifically illustrated in any of the attached figures, an embodiment of the present invention may also include use of the vibrating roller device in conjunction with other products. A "U-shaped" arm cradle may be placed on either side of a vibrating roller device while the user lies supine or prone on the roller. The cradles would support the weight of the user's arms, thereby allowing the user to achieve a more rested position. Additionally, the arm cradles may be fitted with insert holes to allow for use of the apparatus in conjunction with resistant bands. An additional modification to the apparatus is the use of the vibrating roller device with a 'roller cover.' A roller cover may be wrapped around the roller, which can then be closed by velcro, or some similar means of fastening used in the art. A roller cover may create a 'bumpy' textured surface to the roller, which will create an alternate type of stimulation to the muscles and myofascia. Also, another type of roller cover may be fitted with additional padding at the head and lower back for a user who requires extra support due to extreme curvatures of the neck and lower back. The additional padding may provide a slight lift for a user suffering from hyperextension of the neck or chronic strain of the lower back.

While the present invention has been particularly described, in conjunction with various specific embodiments, it is evident that many alternatives, modifications and variations will be apparent to those skilled in the art in light of the foregoing description. It is therefore contemplated that the present invention will include any such alternatives, modifications and variations.

What is claimed is:

1. A device for stimulating fascial tissue of a user, comprising:

a roller having an outer surface that is configured to exert a force on a bodypart of a user when the bodypart is in contact with the roller, the roller being positionable to extend along a user's spine;

a vibration mechanism received entirely inside an inner bore of the roller, the vibration mechanism being configured to generate vibrations for acting upon the bodypart of the user, wherein the force exerted by the outer surface of the roller and the vibrations generated by the vibration mechanism cause fascial tissue of the bodypart to be stimulated, and wherein the bodypart is one of a plurality of bodyparts onto which the roller is configured to exert a force, such that the roller is configured to cause the neurofascial system and fascial tissue of the plurality of bodyparts to be stimulated to cause a whole-body hydration effect.

2. The device of claim 1, further comprising a cradle attached to the roller.

3. The device of claim 2, wherein the cradle is a head cradle.

4. The device of claim 2, wherein the cradle is supported within the bore.

5. The device of claim 2, wherein the cradle is configured to support a user's head when the roller is positioned to extend along the user's spine.

6. The device according to claim 1, wherein the vibration mechanism is accessible at an open end of the bore at a first axial end of the roller such that the vibration mechanism is removable through the open end of the bore at the first axial end of the roller.

7. The device according to claim 6, further comprising a head cradle attached to the roller, the head cradle disposed at a second axial end of the roller opposite the first axial end of the roller.

8. The device according to claim 7, wherein the head cradle is removably attachable to the roller by inserting a portion of the head cradle axially into the bore.

9. The device according to claim 7, wherein a height and an angle of the head cradle are adjustable.

10. The device according to claim 1, wherein the roller and the vibration mechanism are a same length.

* * * * *